US006910750B2

(12) United States Patent
Jones et al.

(10) Patent No.: US 6,910,750 B2
(45) Date of Patent: Jun. 28, 2005

(54) LOW-PROFILE INK HEAD CARTRIDGE WITH INTEGRATED MOVEMENT MECHANISM AND SERVICE STATION

(75) Inventors: Randy Q. Jones, Sunnyvale, CA (US); Jan E. Unter, Granite Bay, CA (US); George L. Bradshaw, Palo Alto, CA (US)

(73) Assignee: Elesys, Inc., Sunnyvale, CA (US)

( * ) Notice: Subject to any disclaimer, the term of this patent is extended or adjusted under 35 U.S.C. 154(b) by 77 days.

(21) Appl. No.: 10/159,729

(22) Filed: May 30, 2002

(65) Prior Publication Data

US 2002/0145636 A1 Oct. 10, 2002

Related U.S. Application Data

(63) Continuation-in-part of application No. 09/872,345, filed on Jun. 1, 2001, now abandoned.
(60) Provisional application No. 60/208,759, filed on Jun. 2, 2000.

(51) Int. Cl.[7] ..... B41J 3/00
(52) U.S. Cl. ..... 347/2; 347/4; 347/86
(58) Field of Search ..... 359/18; 347/2, 347/4, 38, 39, 86

(56) References Cited

U.S. PATENT DOCUMENTS

| | | | | |
|---|---|---|---|---|
| 4,110,594 | A | 8/1978 | May | 291/121 |
| 4,556,966 | A | 12/1985 | Bricot et al. | 369/52 |
| 4,721,969 | A | 1/1988 | Asano | 346/157 |
| 4,739,415 | A | 4/1988 | Toyono et al. | 358/296 |
| 4,872,026 | A | 10/1989 | Rasmussen et al. | 346/140 |
| 5,041,846 | A | 8/1991 | Vincent et al. | 346/25 |
| 5,115,250 | A | 5/1992 | Harmon et al. | 346/1.1 |
| 5,154,957 | A | 10/1992 | Yamada et al. | 428/64 |
| 5,317,337 | A | 5/1994 | Ewaldt | 346/1.1 |
| 5,444,687 | A | 8/1995 | Okumura | 369/50 |
| 5,468,076 | A | 11/1995 | Hirano et al. | 400/59 |
| 5,518,325 | A | 5/1996 | Kahle | |
| 5,597,590 | A | 1/1997 | Tanimoto et al. | 425/174.4 |
| 5,634,730 | A | 6/1997 | Bobry | 400/88 |
| 5,656,229 | A | 8/1997 | Tanimoto et al. | 264/400 |
| 5,967,676 | A | 10/1999 | Cutler et al. | 400/70 |
| 6,019,151 | A | 2/2000 | Wen et al. | 156/387 |
| 6,202,550 | B1 | 3/2001 | Lee et al. | 101/38.1 |
| 6,264,295 | B1 | 7/2001 | Bradshaw et al. | 347/2 |
| 6,270,176 | B1 * | 8/2001 | Kahle | 347/2 |

FOREIGN PATENT DOCUMENTS

| | | | |
|---|---|---|---|
| EP | 0952725 A2 | 10/1999 | |
| JP | 07101039 | 4/1995 | B41F/17/14 |
| JP | 09265760 | 7/1997 | G11B/23/28 |
| JP | 09306144 | 11/1997 | G11B/23/40 |
| WO | WO00/32399 | 6/2000 | |

* cited by examiner

*Primary Examiner*—Hai Pham
*Assistant Examiner*—Lam Nguyen
(74) *Attorney, Agent, or Firm*—Beyer, Weaver & Thomas LLP

(57) ABSTRACT

Disclosed are embodiments of an ink cartridge that includes therein a print head for dispensing ink onto a media, a movement mechanism for enabling movement of the print head, and/or an ink service station. In one embodiment, the cartridge is designed to be inserted into a receptacle so that the cartridge and receptacle form a radial printing system. The receptacle may also include a motion actuator for engaging with the movement mechanism of the cartridge to thereby move the print head of the cartridge. The movement mechanism of the cartridge works in conjunction with the actuator of the receptacle to thereby move the print head with respect to the cartridge, e.g., moving into and out of the cartridge, and with respect to a rotating media to enable ink to be dispensed by the print head along a radius of a rotating circular media. In a specific implementation, the cartridge remains fixed with respect to the media. In an example application, the radial print system may be used to print a label on the top surface of a recordable circular media, such as a recordable compact disc (CD-R).

27 Claims, 16 Drawing Sheets

LOW-PROFILE INK HEAD CARTRIDGE WITH INTEGRATED MOVEMENT MECHANISM AND SERVICE STATION

CROSS REFERENCE TO RELATED APPLICATIONS

This application is a continuation-in-part of U.S. patent application Ser. No. 09/872,345, filed Jun. 1, 2001, now abandoned, which claims the benefit of U.S. Provisional Patent Application No. 60/208,759, filed Jun. 2, 2000. This application is also related to U.S. Pat. No. 6,264,295, issued Jul. 24, 2001. These applications and patent are incorporated herein by reference in their entirety for all purposes.

BACKGROUND OF THE INVENTION

The present invention relates to printing systems and methods for printing with the same. More particularly, the present invention relates to printing systems with cartridges that are configured to radially print onto a media that rotates in relation to a printing assembly.

Conventional printing systems typically utilize rectangular based bitmaps. In general, a conventional printing system prints onto a standard size rectangular-shaped media along a horizontal axis, for example, and the media is moved along a vertical axis. Typically, after the paper advances to a desired vertical location under a head assembly, the printing assembly moves across the paper to print an image onto the paper while the paper is held stationary. In sum, conventional printing systems generally implement movements within a rectangular coordinate system for printing onto media having standard sizes and shapes.

To facilitate discussion, FIG. 1 depicts a conventional printing system 10 in the form of a typical ink jet printer. As shown, the printing system 10 includes a print head 102, a roller 106, an actuator 108, and an ink head service and capping area 120. The print head 102 is configured for dispensing ink onto a print media 100, representing, for example, a rectangular sheet of paper. The actuator 108 is configured for moving the print head 102 across the print media 100. The roller 106 is configured for moving the print media 100 under the print head 102.

Typically, the roller 106 moves the print media 100 perpendicularly to the movement of the print head 102. That is, the media 100 travels under the print head 102 along a y-axis 110, and the print head moves over the media 100 along an x-axis 112. Periodically to service the ink jet nozzles, the print head 102 is moved past the paper edge along an x-axis to the service station 120, where it clears, wipes 126 and caps 124 the nozzles.

Although conventional printing systems such as those described above are suitable for certain applications, they also have certain disadvantages. The print head cartridge in conventional ink jet printers, for example, as disclosed in U.S. Pat. No. 4,872,026, are typically optimized for printing rectangular objects like paper using x-y axis coordinate system printers, and are inherently not optimized for printing along radial axis.

FIG. 2 illustrates a radial print system 200, as disclosed in U.S. Pat. No. 6,264,295, issued Jul. 24, 2001. In the radial printing system 200, the head assemble 210 in one embodiment of this invention consists of a conventional ink jet cartridge that also has print head 102 that moves radially and tangentially to the spinning media underneath in contrast to the conventional printing system 10 of FIG. 1, which moves print head 102 in the x-axis direction across the media 100 under print while the media 100 gradually advances along the y-axis. Where on the one hand, the spatial resolution of the ink object resolution is normally constant across the conventional printing system 10 media, on the other hand, the spatial resolution of the radial print system printing ink objects increases as the radial position of the ink jet cartridge increases with respect to the circular CD-R media.

The ink jet cartridges designed for use in conventional printing system are inherently not optimized to place ink object for radial printing. FIGS. 3*a* and 3*b* illustrate the bottom view of a conventional cartridge 300 that has nozzles 320 with orientation, firing order, and firing rates optimized for rectangular printing in the orthogonal or Cartesian reference coordinate system. However, this same cartridge print head and nozzles produce non-optimal results when used to print radially in the polar reference coordinate system. For example, in a conventional printing system cartridge 300, nozzles 320 are usually arranged along a parallel vertical lines offset 334 from the centerline 330 of the print head 310. While this design may be optimal for rectangular printing, in contrast during radial printing this orientation causes distortion due in part to the misalignment of the nozzle axes 320 relative to the radial centerline 330. To partially correct for this, the each respective nozzle axis, 320*a* and 320*b*, must be laterally translated in motion an offset distance 334 so as to be centered over the radial centerline 330 prior to printing. This extra translation requirement causes extra steps to be added to the radial printing system operation and reduces overall print speed and performance.

Another limitation associated with using conventional rectangular-optimized cartridges 300 in the radial print system 200 is the way conventional print head nozzles 320 are designed to operate. In conventional printer operations, the firing order of each nozzle is typically addressed electronically using a grid-like, row-column technique, to more easily enable the nozzles in conventional cartridges to fire at the appropriate time optimized for the rectangular media printing environment or to simplify the electronics interface. Since the conventional print head nozzles 320 are typically arranged to be fired optimally in column order instead of azimuthal 340 or radial order, printing is inherently slower for radial printing and print speed diminishes due to missed printing opportunities. For example, because conventional cartridge nozzles 310 usually are fired in column order, the target zone where to place an ink object may pass by before the next addressed nozzle is ready to fire, necessitating the target to pass repeatedly underneath the print head nozzles 320. In this case until it is ready to fire, the print head 310 must linger over the spinning media, awaiting the target zone for a much longer period of time than is optimal in order to ensure complete ink object coverage. Another aspect of these design limitations of conventional print heads 310 causes the column addressing modes to constrain and restrict the firing order during radial printing operation, to the extent that the next radial dot position is missed, because the firing order cannot be configured flexibly enough or fast enough to allow for optimal azimuthal 340 print coverage.

Yet another disadvantage of ink jet cartridges 300 used in conventional rectangular printers is that their vertical height is too tall for particular printing applications. Conventional ink jet cartridges are usually not designed to limit physical height, but rather are so designed to be as tall as practical for larger ink reservoir capacity.

Another disadvantage of conventional printing systems using ink jet technology is the necessity for a separate print head service device. Referring back to FIG. 1, the conventional design of a print head 102 necessitates it being serviced frequently to maintain optimal performance of the print head, so a separate service station 120 is required to wipe 126 and clear the print head 102 nozzles during printing and cap 124 the print head for storage while not in use. This service station is often a separate device 120 inline with the x-axis 112 direction of the print head 102 movement, beyond the placement of the media 100. However, for a radial print system, a separate service station may occupy substantial portions of the space available in a radial printing system. In addition, a separate service station 120 can inherently slow down printing due to the need to add extra motion steps outside the normal radial positioning motion during the radial printing operations.

In view of the foregoing, there is a need for an improved printing system cartridge for radial printing that efficiently implements simple movements, inherently reduces distortion while minimizing the amount of space taken by such cartridge within a radial printing system.

SUMMARY

In general terms, the present invention provides an ink cartridge that includes therein a print head for dispensing ink onto a media, a movement mechanism for enabling movement of the print head, and/or an ink service station. In one embodiment, the cartridge is designed to be inserted into a receptacle so that the cartridge and receptacle form a radial printing system. The receptacle may also include a motion actuator for engaging with the movement mechanism of the cartridge to thereby move the print head of the cartridge. The movement mechanism of the cartridge works in conjunction with the actuator of the receptacle to thereby move the print head with respect to the cartridge, e.g., moving into and out of the cartridge, and with respect to a rotating media to enable ink to be dispensed by the print head along a radius of a rotating circular media. In a specific implementation, the cartridge remains fixed with respect to the media. In an example application, the radial print system may be used to print a label on the top surface of a recordable circular media, such as a recordable compact disc (CD-R).

In one aspect, the cartridge and receptacle are sized into a slim form factor. In one exemplary embodiment of this invention, the cartridge and receptacle together serve as an ink jet printing system. Accordingly, the cartridge includes one or more ink storage mechanisms, such as ink storage bladders, a mechanism to enable print head positioning, and a mechanism to perform print head servicing, including nozzle clean-out, nozzle wiping, and nozzle capping for storage. When this cartridge is inserted into a radial printing system receptacle, mating receptacle components, such as a communication bus coupled with a processor, externally activate the cartridge to enable printing. These mating receptacle components also actuate internal cartridge motion mechanisms to achieve movement of the print head.

In a preferred embodiment, the cartridge is operable to enable printing onto spinning CD-R media while mounted and positioned over or integrated with a standard slimline-height CD-R drive. More particularly, some of the particular embodiments of the present invention provide a printing ink jet "print head" cartridge that fits into a printing receptacle, and the combination of the cartridge and printing receptacle are positioned adjacent to or integrated with a standard slimline-height CD-R drive. Consequently, the cartridge and printing receptacle are designed so that a combination of the cartridge, printing receptacle and CD-R drive substantially fits within a standard ½-height computer bay or in a externally mounted computer peripheral device or bay of existing computer systems. In a specific implementation, the cartridge is designed to have a height that is less than or equal to a slimline-height CD-R drive (currently sized to be 20.7 mm or less in height). Most preferably, the cartridge has a height less than or equal to the size of an opening for receiving CD-ROMS (currently sized to be about 14 mm or less in height). Additionally, the cartridge preferably has a width and length that are less than or equal to a slimline CD-R drive (currently sized to 146 mm or less in width and 203 mm or less in length, respectively).

Some of the specific cartridge embodiments are removable from and insertable into a printing assembly that is mounted in a computer bay. A removable cartridge may contain replaceable and disposable portions that may be inserted or removed, permitting new features or extensions in function. Accordingly, users may freely and easily swap printing cartridges, as one might now do with floppy disks. For example, this enables repetitively swapping out specialty printing cartridges with alternate colors or other featured coatings to layer onto the same target CD-R under print.

In one embodiment, a printing cartridge for radially printing onto a rotating circular media is disclosed. The cartridge includes an ink print head having a plurality of nozzles operable to dispense ink onto the rotating circular media and a motion mechanism coupled with the ink print head to allow radial movement of the print head over the rotating circular media.

In a specific implementation, the motion mechanism is designed to be engagable with an actuator of a receptacle when the cartridge is coupled with the receptacle, and the actuator is operable to move the print head via the motion mechanism. In a further aspect, the motion mechanism is a cam wheel having a groove for receiving a pin coupled to the print head. The cam wheel is engagable with the actuator of the receptacle when the cartridge is coupled with the receptacle, and the actuator is operable to rotate the cam wheel and move the print head via the pin moving along the groove. In yet a further aspect, the motion mechanism further includes a bladder assembly for supporting an ink reservoir coupled to the print head, and the bladder assembly is also coupled with the print head. In yet another embodiment, the bladder assembly includes two pivots on two opposing sides of the bladder assembly, and the pivots are positioned to slidably and pivotably engage with two rails of an inside surface of the cartridge.

In one aspect, the groove is configured to allow vertical and horizontal movement of the print head when the cam wheel rotates. In a specific implementation, the cam wheel includes a service station for maintaining the print head. For example, the service station includes a spit, a wipe, and a cap device. In a further aspect, the groove is further configured to rotate the print head over the service station.

In another implementation, the cartridge and the receptacle are arranged together so that the cartridge remains in a fixed position with respect to the rotating media when the print head is moving over the media.

In an alternative embodiment, the motion mechanism includes an attachment mechanism coupled with the print head, and the attachment mechanism is engagable with the actuator of the receptacle when the cartridge is coupled with the receptacle. The actuator is operable to move the print head via the attachment mechanism. In one aspect, the actuator includes a motor coupled with a lever arm which is engageable with the attachment mechanism when the cartridge is inserted within the receptacle. In yet another aspect, the motion mechanism includes a second attachment mechanism coupled with a service platform, and wherein the attachment mechanism is engagable with a second actuator of the receptacle when the cartridge is coupled with the receptacle, and the second actuator is operable to move the service platform with respect to the print head via the second attachment mechanism.

In a further embodiment, the cartridge is sized to couple with a printer receptacle, wherein the printer receptacle is positioned adjacent to or integrated with a standard slimline CD-R device, so that a combination of the cartridge, the printer receptacle and the standard slimline CD-R device substantially fit within a standard ½ height computer bay.

In a further implementation, the cartridge includes a print service component configured to service the print head by cleaning and/or capping the nozzles of the print head. In one aspect, the cartridge is has a similar size as a slimline type CD-R drive bay.

In another embodiment, the invention pertains to a method of radially printing onto a rotating media using a cartridge having an ink print head having a plurality of nozzles operable to dispense ink onto the rotating circular media and a motion mechanism coupled with the ink print head to allow radial movement of the print head over the rotating circular media. The motion mechanism of the cartridge is engaged to thereby move the print head over the rotating circular media, and ink is dispensed onto the rotating circular media. In one aspect, the engaging operation includes activation of a servicing operation on the print head. In one application, the cartridge is inserted into a slimline printer system to activate engagement of the motion mechanism of the cartridge. In another application the cartridge is inserted into a combination compact disc recorder and printer system which is sized to fit within a standard height computer bay to activate engagement of the motion mechanism of the cartridge.

In yet another embodiment, a radial printing and compact disc recording (CD-R) system is disclosed. The system includes a CD-R drive for recording on a rotating media, the CD-R drive having a standard slimline size and a radial printing receptacle arranged to receive a cartridge. The radial printing receptacle is positioned adjacent to or integrated with the CD-R drive, and the radial printing receptacle and cartridge are operable to print onto the rotating media. The radial printing receptacle and cartridge are sized such that a combination of the radial printing receptacle, cartridge, and CD-R drive substantially fit within a standard ½ height computer bay.

In a specific implementation, the cartridge includes an ink print head having a plurality of nozzles operable to dispense ink onto the rotating media and a motion mechanism coupled with the ink print head to allow radial movement of the print head over the rotating media. The radial movement is defined with respect to a circular motion of the rotating media. In a further aspect, the motion mechanism is designed to be engagable with an actuator of a receptacle when the cartridge is coupled with the receptacle, the actuator being operable to move the print head via the motion mechanism.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF SPECIFIC EMBODIMENTS

Reference will now be made in detail to a specific embodiment of the invention. An example of this embodiment is illustrated in the accompanying drawings. While the invention will be described in conjunction with this specific embodiment, it will be understood that it is not intended to limit the invention to one embodiment. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

The present invention relates to circular recording media, such as an optical disc, such as a recordable compact disc (CD-R). For the scope of this invention, the terms "CD-R" and "CD" are intended to mean all varieties of recordable circular media (e.g., CD-R, CD-RW, DVD-R, DVD+R, DVD-RAM, DVD-RW, DVD+RW and the like.).

Figure 1:
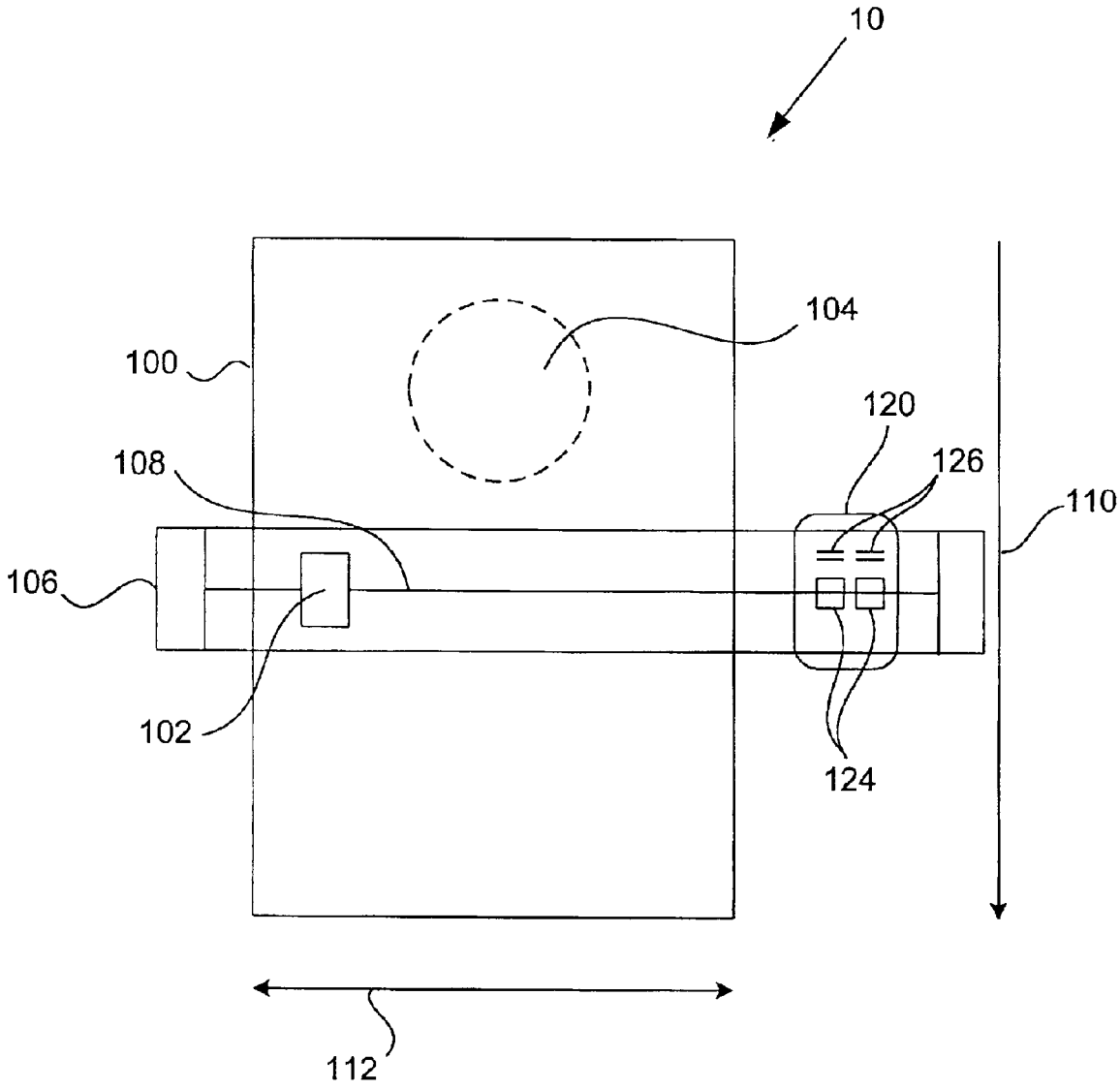
FIG. 1 represents a conventional printing system.
Figure 2:
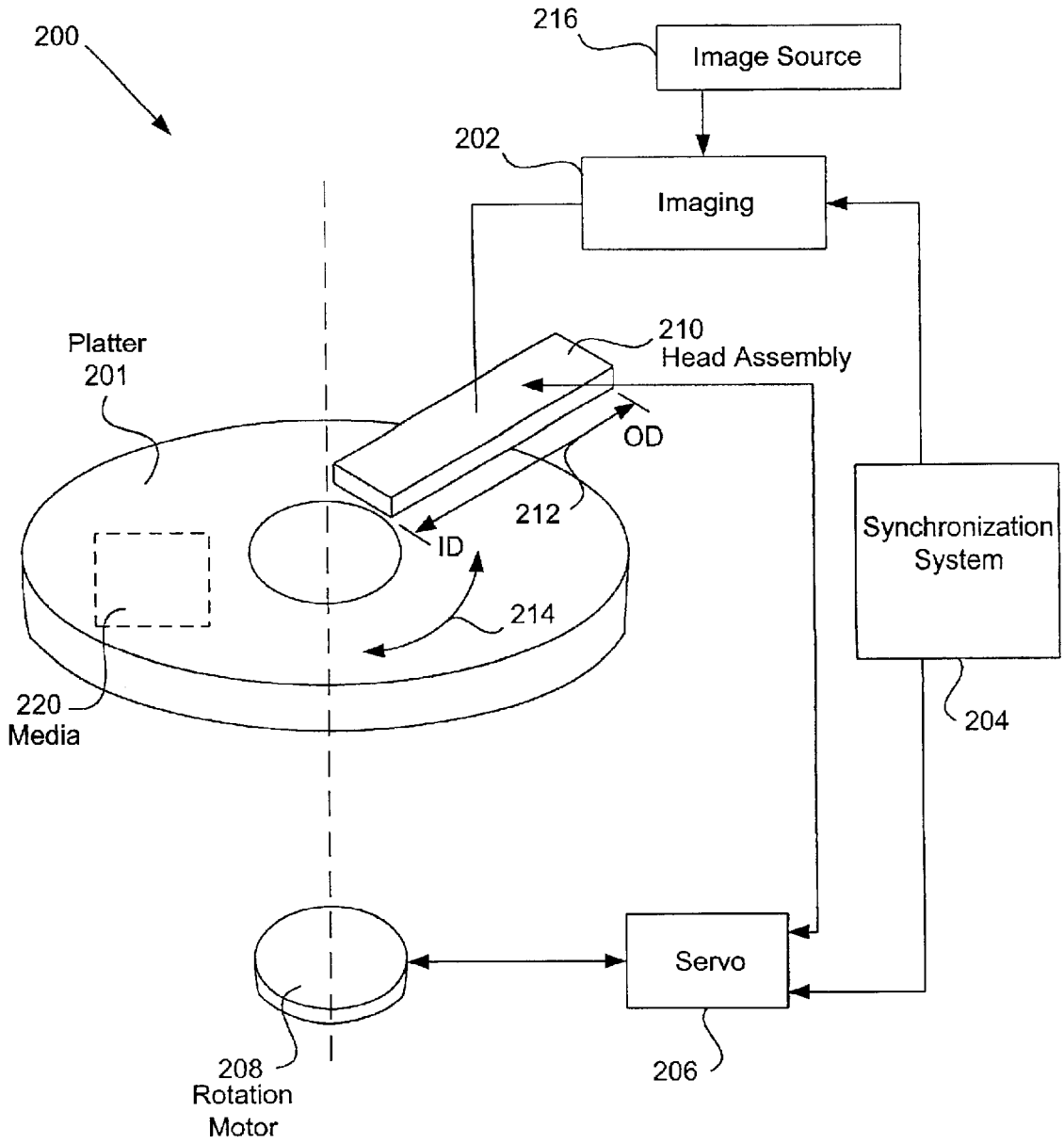
FIG. 2 is a diagrammatic representation of a radial printing system.
Figure 3A:
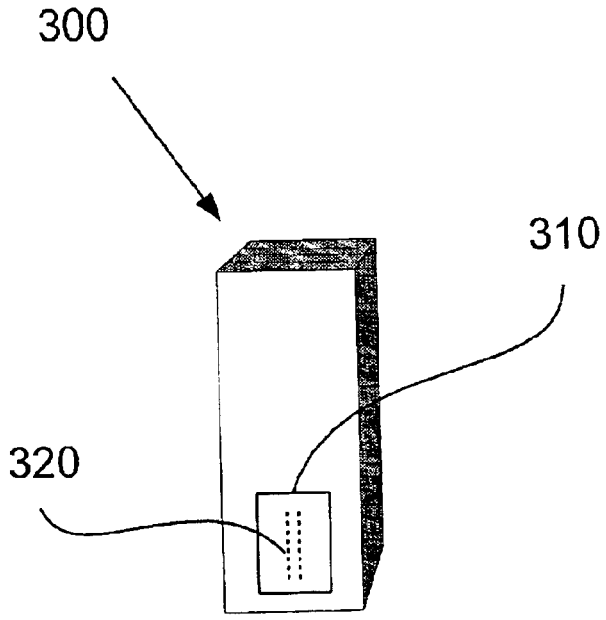
FIG. 3*a* is a diagrammatic representation of the bottom nozzle surface pattern of a conventional ink jet cartridge assembly typically used in FIG. 1.
Figure 3B:
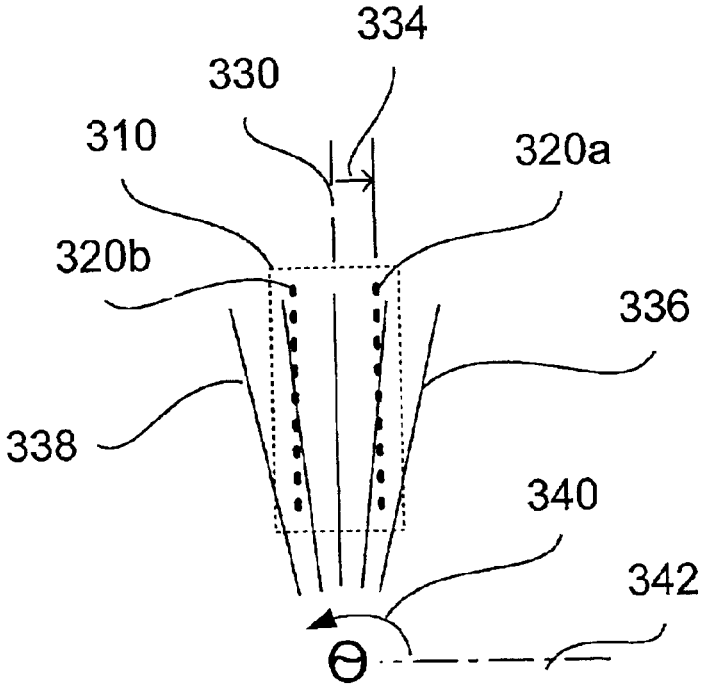
FIG. 3*b* is a diagrammatic representation of the nozzle pattern of a conventional cartridge assembly overlaid onto radial polar coordinate lines as representative in a radial printing system.

Several of the features of the present invention may be used in conjunction with the printing system features illustrated in FIG. 1 and described further in U.S. Pat. No. 6,264,295, issued Jul. 24, 2001, which patent is incorporated herein by reference in its entirety. That is, the system features disclosed in this patent may be easily integrated with the cartridge or printing system of the present invention.

Figure 5:
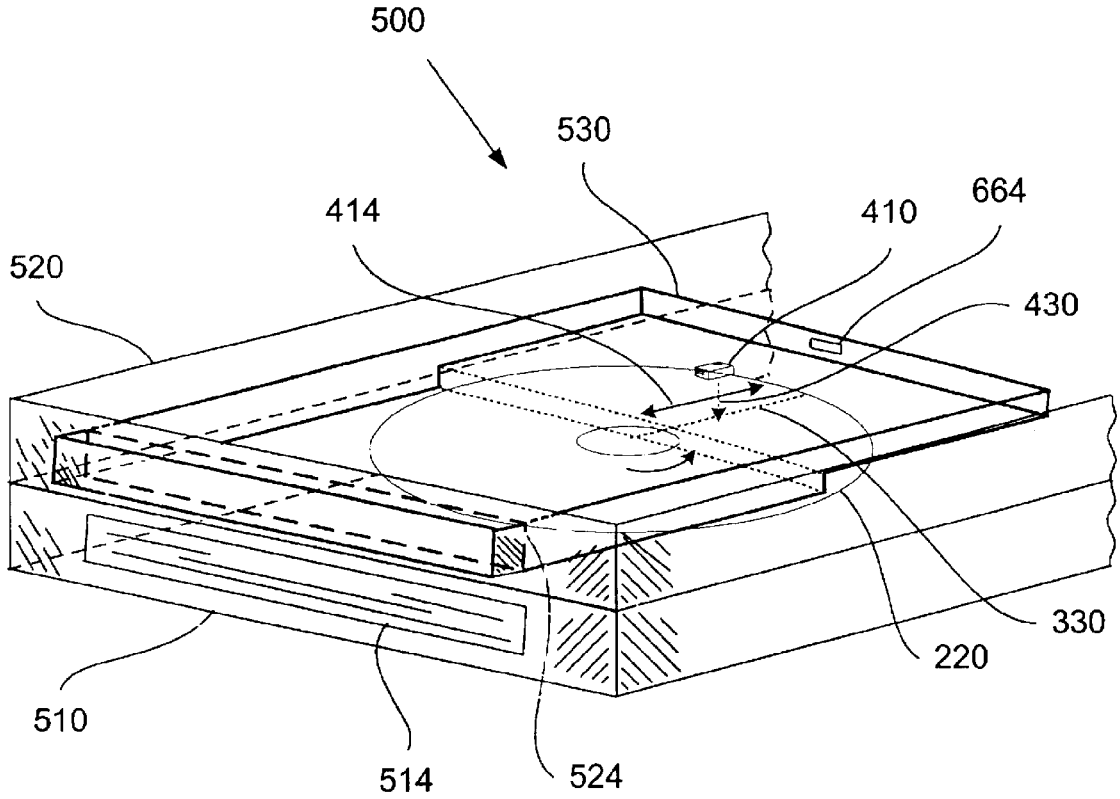
FIG. 5 is a diagrammatic representation of a combination device consisting of a slimline CD-R drive and radial printing system in accordance with one embodiment of the present invention.

FIG. 5 illustrates a combination CD-R device or drive and radial printing system 500 in accordance with one embodiment of the present invention. The combination system 500 includes a low-profile radial printer system 520 having a cartridge system 530 that is designed to physically mate with, substantially mount directly over or adjacent to, and/or may be manufactured in combination with a standard slimline CD-R device 510, such as Teac model CD-W216E and the like, which CD devices are often used in present-day computer laptops and are well known to those familiar with the art. Preferably, the combined standard slimline CD-R device 510 and cartridge system 530 substantially fit within a standard ½ height computer bay.

As described further below, the system 500 includes a receptacle for receiving the cartridge, as well as for providing other printing operations. In one illustrated embodiment, the receptacle may include one or more of the following components: an interlocking mechanisms (e.g. 524) for coupling with and ejecting of the cartridge, one or more actuators for facilitating movement of a print head within the cartridge (e.g. 604 and 606 of FIG. 6*a* or 1212, 1210, 1214, and 1216 of FIG. 14), and hardware and/or software components for enabling printing (e.g., 660).

During use, the user may press or snap the cartridge 530 into an interlocking mechanism 524 in the printer system 520 and thereby place the cartridge 530 substantially horizontally into position over the media 220. Through means either independent of the radial printer system or under control of the radial printer system, the user may insert or remove the media 220 via the CD-R tray mechanism 514. During the CD-R printing operation, the cartridge 530 is activated from the radial printer mechanism 520, which engages the cartridge 530 to move the print head 410 into position over the CD-R media 220.

The interlocking mechanism is in the form of any suitable device for providing active restraint of the cartridge. By way of examples, the interlocking mechanism may be in the form of a positive detent or clasp. The interlocking mechanism may be operable to grab the cartridge as it is inserted within the tray 514 and then pull and lock the cartridge into the printing system 520. The interlocking mechanism may be similar to a ZIP drive's locking mechanism. The interlocking mechanism is also operable to eject the cartridge from the printing system. For example, the interlocking mechanism may be coupled with a processor, which is configured to activate an ejection (e.g., via activation of a solenoid) when printing is complete. The interlocking mechanism may also include a user selectable eject mechanism which the user may activate to eject the cartridge. This user selectable ejection mechanism may also be controlled by a processor to prevent the cartridge from being ejected during printing or to query whether the user really wants to eject prior to activating ejection of the cartridge.

Figure 4A:
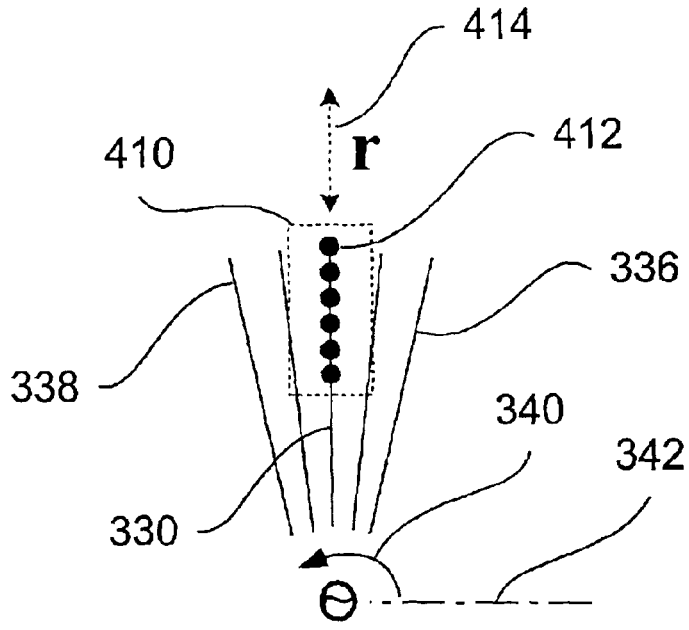
FIG. 4*a* is a diagrammatic representation of the radial print head of a radial cartridge assembly with its nozzles positioned over and substantially along the radius of a CD-R media, in accordance with one embodiment of the present invention.
Figure 4B:
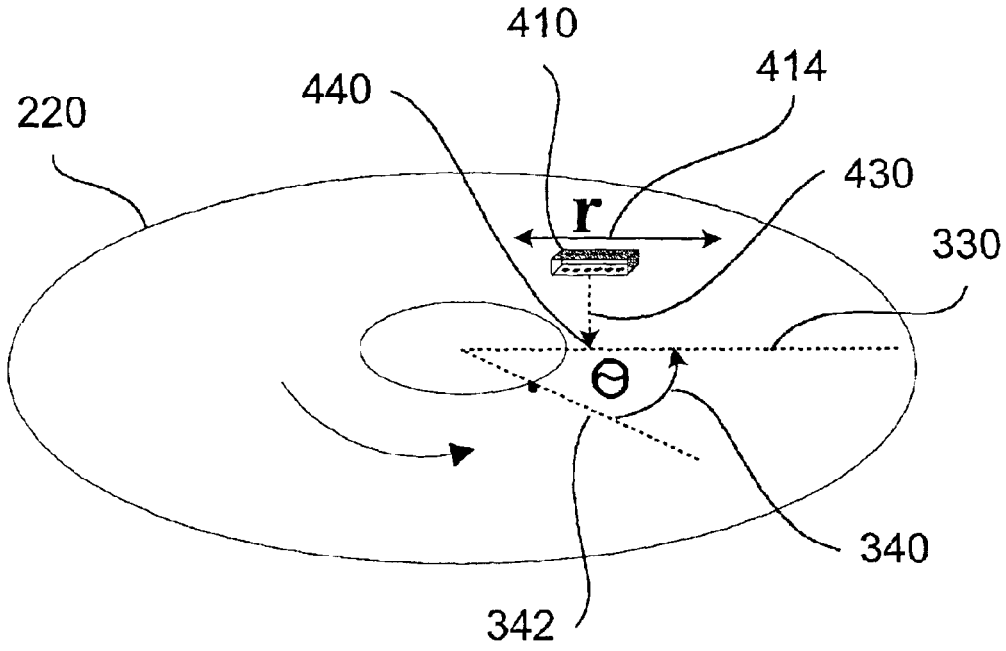
FIG. 4*b* is a diagrammatic representation of the optimal placement of the radial nozzle pattern of a radial cartridge print head with respect to the radial coordinate lines over spinning media in a radial printing system, in accordance with one embodiment of the present invention.

The design of the print head 410 is preferably of a type, a technology and a form or adapted for use with radial printing from a variation on a form of those widely known and extensively covered under prior art and well understood by those familiar with the art. For example, the print head could be designed using thermal ink jet or piezoelectric technologies commonly used in the art. Mounting or coupling this print head to the ink supply could use techniques widely known in the art. FIG. 4*a* shows the radial print head 410 of FIG. 5 with nozzles 412 aligned along the radial centerline 414 in accordance with a preferred embodiment of the present invention. A print head designed for radial printing in this fashion and thus aligned over the radial axis enables printing successive concentric annual print position lines 336 as the media 220 passes under the nozzles 412, and thus align directly with nozzle positions without the need for further lateral translation, minimizing distortions. This is also shown in a perspective view in FIG. 4*b*, illustrating the placement of the radial print head 410 in relation to the media 220 and the radial print centerline 330, offset by azimuthal angle 340 from a reference origin radial line 342. In this configuration, radial print head nozzles 412 ideally fire in time so as to place ink objects substantially on the radial centerline 330 as the media 220 spins underneath. In sum, the print head designed for radial printing in this fashion, optimizes placement of ink objects directly along the radial axis, minimizing print distortion.

Figure 9A:
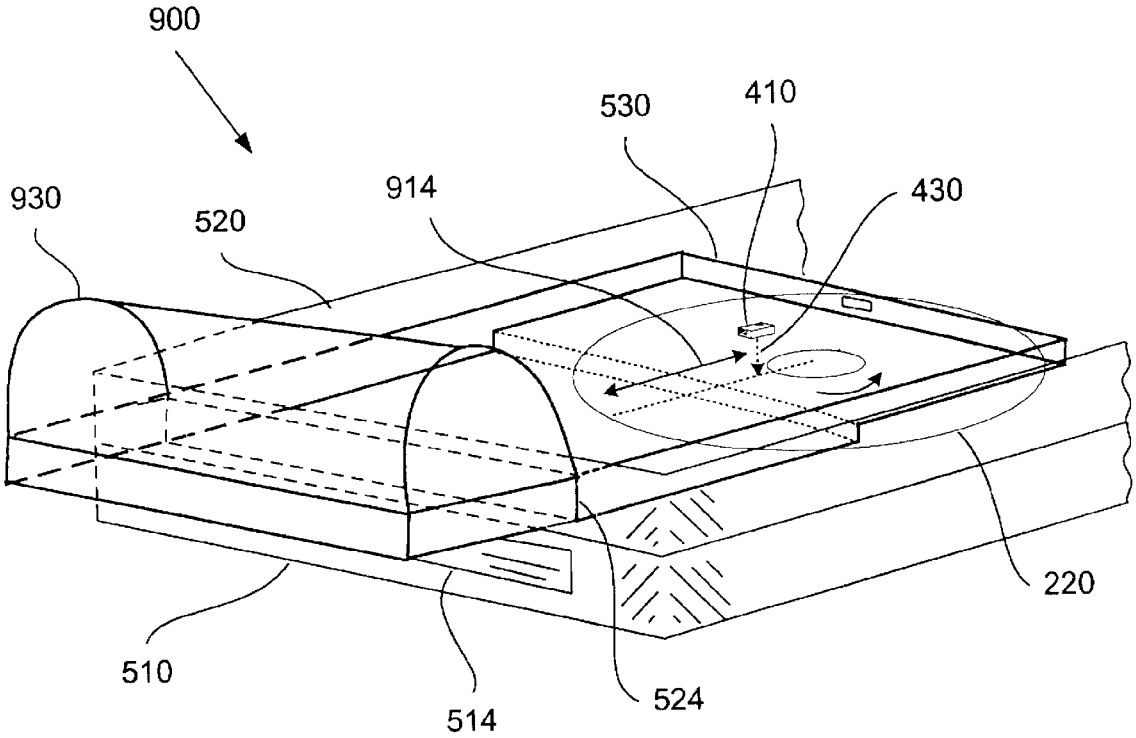
FIGS. 9*a* and 9*b* are diagrammatic perspective view and side view representations, respectively, of an extended ink supply cartridge used for CD-R radial printing in accordance with an alternative embodiment of the present invention.

The cartridge also includes a motion mechanism that enables movement of the print head 410 with respect to the media. The motion mechanism is coupled with the print head and arranged to also be engagable with an external actuator so that the external actuator activates the motion mechanism to thereby move the print head. In one embodiment, activation of the motion mechanism causes the print head 410 to be physically translated over any portion of the radial axis 330 of the rotating media 220 (e.g., over the rear 414 portion or the front 914 portion of the media, as shown in FIGS. 5 and 9*a*, respectively).

Figure 6A:
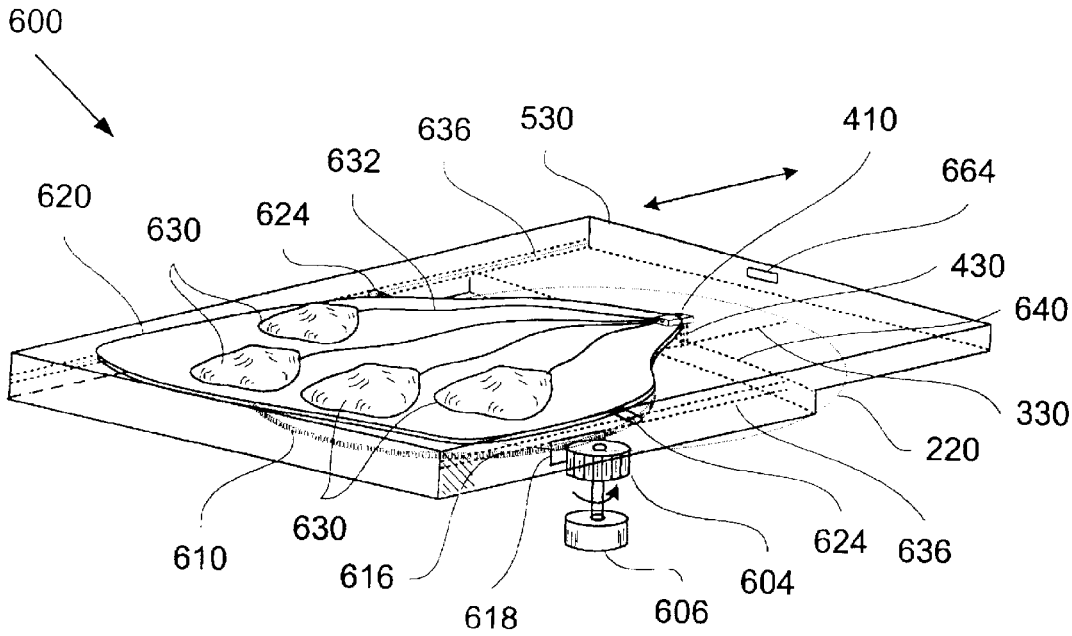
FIG. 6*a* is diagrammatic representation perspective view of the cartridge of FIG. 5 in accordance with one embodiment of the present invention.
Figure 6B:
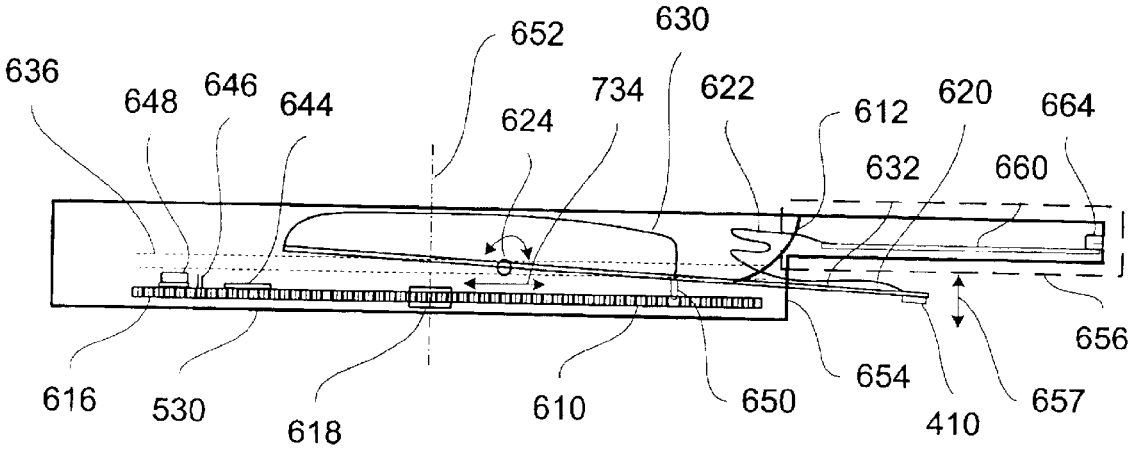
FIG. 6*b* is diagrammatic representation side view of the cartridge of FIG. 5 in accordance with one embodiment of the present invention.

FIGS. 6*a*~6*b* are more detailed diagrammatic representations of the cartridge 530 of FIG. 5, in accordance with one embodiment of the invention. FIG. 6*a* is a perspective view of a portion of the cartridge 530 internal components discussed in FIG. 5, as shown engaged with an external actuator in accordance with one embodiment of the present invention. FIG. 6*b* is a detailed side view of the cartridge 530 described in FIG. 5 engaged with an external actuator in accordance with one embodiment of the present invention.

The cartridge includes any suitable number and type of motion mechanism(s). In the illustrated embodiment as shown in FIGS. 6*a* and 6*b*, the cartridge includes a cam shutter wheel 610, which may be activated by an external actuator. The cam wheel 610 is coupled with the print head through a bladder assembly 620, which holds one or more ink bladders 630 which are coupled to ink pathways 632 which are coupled with print head 410. Movement of the cam wheel 610 substantially causes the print head to move in concert with the bladder assembly.

Figure 6C:
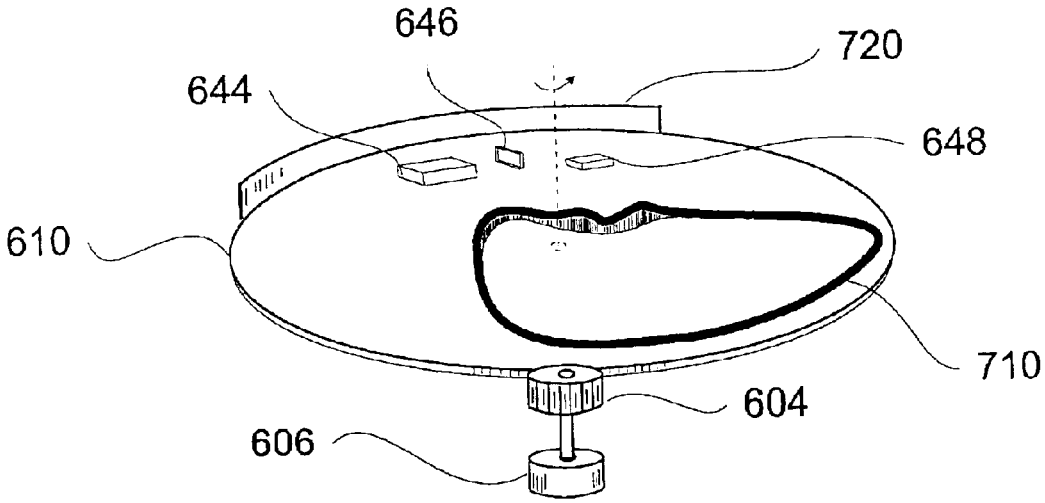
FIG. 6*c* is a diagrammatic top view representation of the cam wheel of the cartridge of FIGS. 6*a* and 6*b* in accordance with one embodiment of the present invention.

As shown in FIGS. 6*a* and 6*b*, the cam wheel 610 is positioned underneath the bladder assembly 620, providing support to the bladder assembly 620 via the tracking pin 650 affixed to the bottom of the bladder assembly 620. FIG. 6*c* is a perspective top view of the cam wheel 610 in accordance with one embodiment of the present invention. Spring 612 (FIG. 6*b*) applies pressure to keep the track tracking pin 650 in the irregular-shaped, raised and/or recessed cam guide track 710 as fashioned in the cam shutter wheel 610 as shown in FIG. 6*c*. Of course, the cam wheel may be alternately positioned over the bladder assembly.

Figure 10:
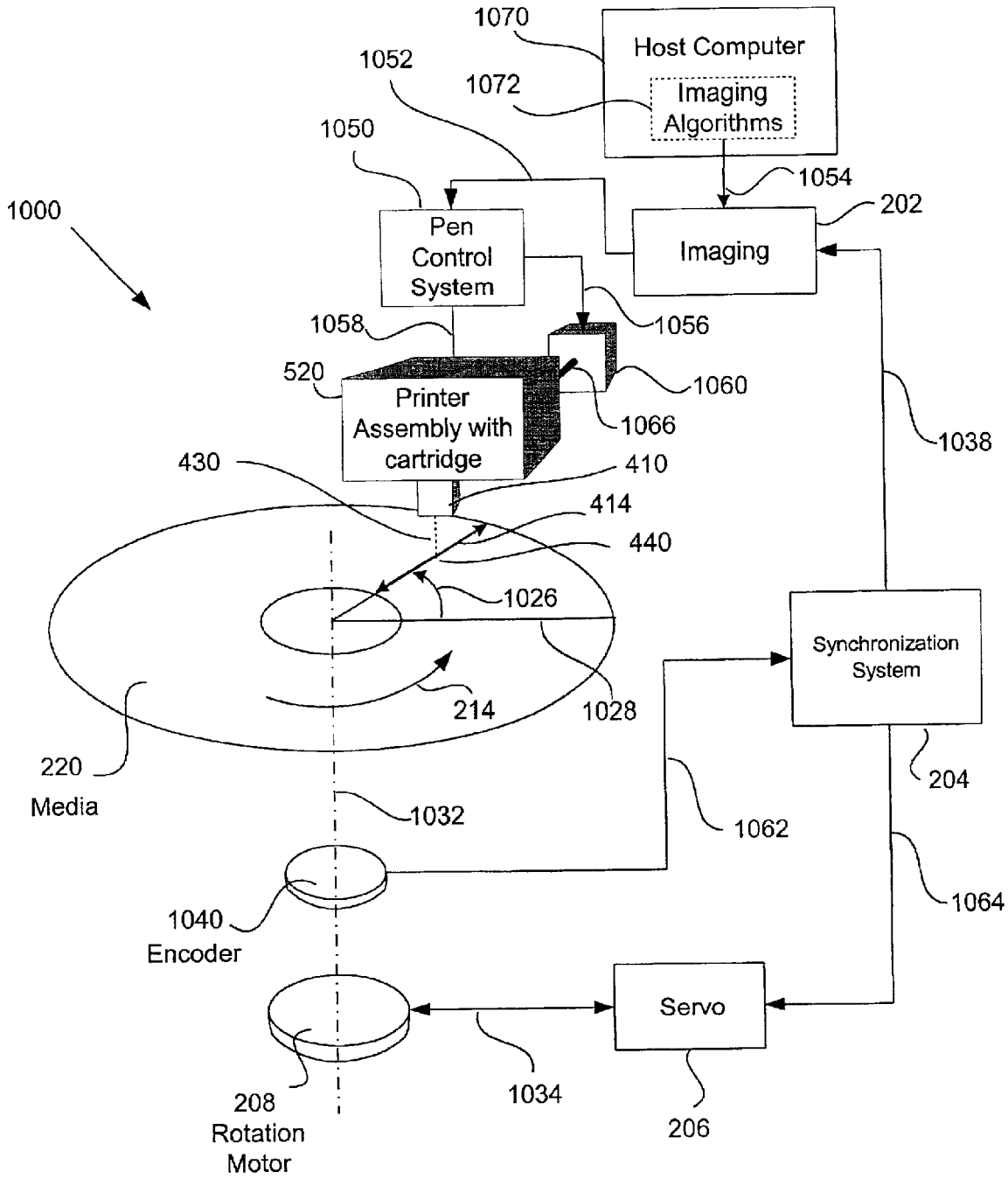
FIG. 10 is a diagrammatic representation of a radial printing system in which the cartridge of the present invention may be implemented.

In the illustrated embodiment, the external actuator may be in the form of a print motor 606, pinion gear 604, and servo actuator (1060 of FIG. 10). The print motor 606 (FIG. 6*a*), pinion gear 604, and servo actuator 1060 (FIG. 10) rotate the cam wheel 610 to position the print head 410 for printing and servicing. In this mode, the pinion gear 604 meshes with gears on the cam wheel 610 to thereby rotate the cam wheel 610. As the cam wheel 610 rotates, the cam guide track 710 generates a print head vertical and horizontal positioning profile, shown in graphical form in FIGS. 8*a* and 8*b*, respectively. As the cam wheel rotates, the bladder assembly 620 also pivots 624 and slides on side rail guide grooves 636 (FIG. 6*a*) located on the inside sides of the cartridge 530 housing. The bladder assembly 620, containing ink bladders 630, ink pathways 632 and print head 410, all pivot together around pivots 624 on either side (see FIG. 6*b*), allowing the entire bladder assembly 620 to move in concert. In a preferred embodiment, a one-piece, rigid bladder assembly potentially reduces ink leak or seal problems and lowers manufacturing costs. Of course, the bladder assembly 620 may be formed from a plurality of parts. However, a single piece assembly 620 is more cost effective to manufacture and maintain. The ink pathways 632 may be capillaries or a capillary sponge material as used in the art, to allow ink to properly flow to the print head. An ink well (not shown) may be located at the capillary end near the print head on the bladder assembly. Also while the print head-bladder assembly 620 is lowered during printing, the slightly downward slope of the pivoted assembly may aid ink flow.

FIG. 6*c* is a diagrammatic top view of the cam wheel 610 of FIGS. 6*a* and 6*b* in accordance with one embodiment of the present invention. As described above, the cam wheel 610 includes a guide track 710 for receiving the tracking pin 650 affixed to the bottom of the bladder assembly 620. The guide track 710 may be embossed, machined, milled, molded, stamped, or otherwise fashioned into or attached onto the cam shutter wheel 610 of the print head positioning mechanism. This guide track 710 is so shaped as to accurately profile the complete movement cycle to substantially support all necessary print head positioning, printing and servicing operations.

Figure 7A:
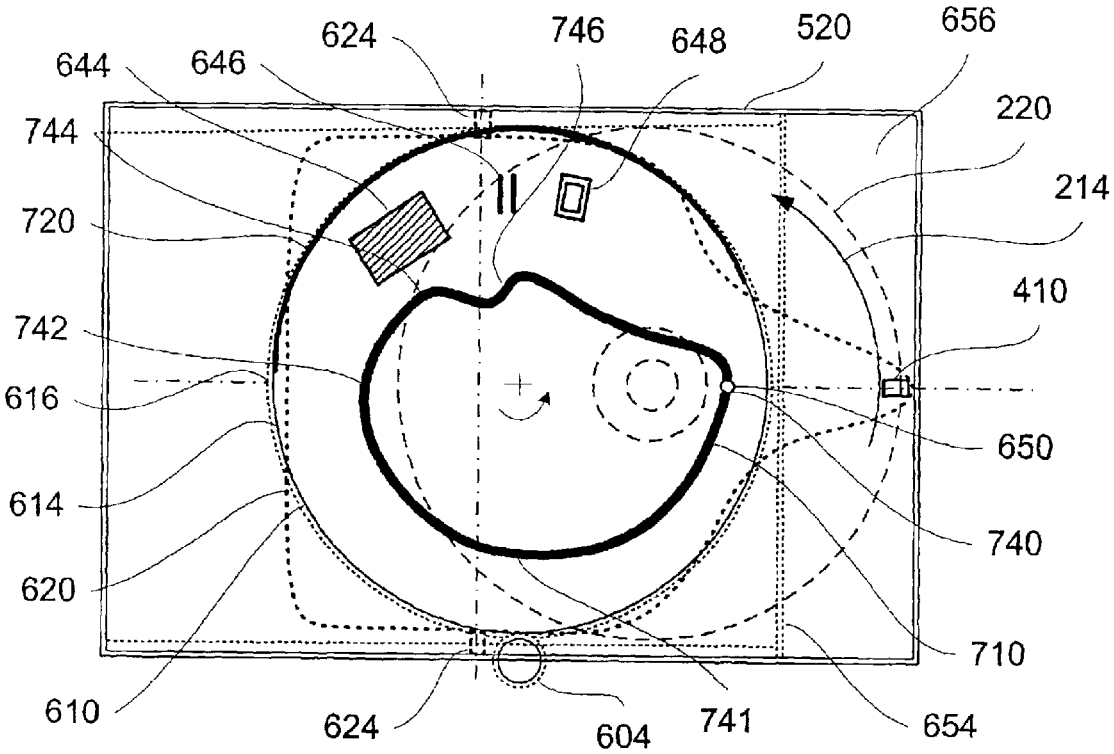
FIGS. 7*a*~7*e* are diagrammatic top view representations of the cam wheel and print head positioned in relation to the cartridge and media 220 at various stages within the print and maintenance cycle in accordance with one embodiment of the present invention.
Figure 7B:
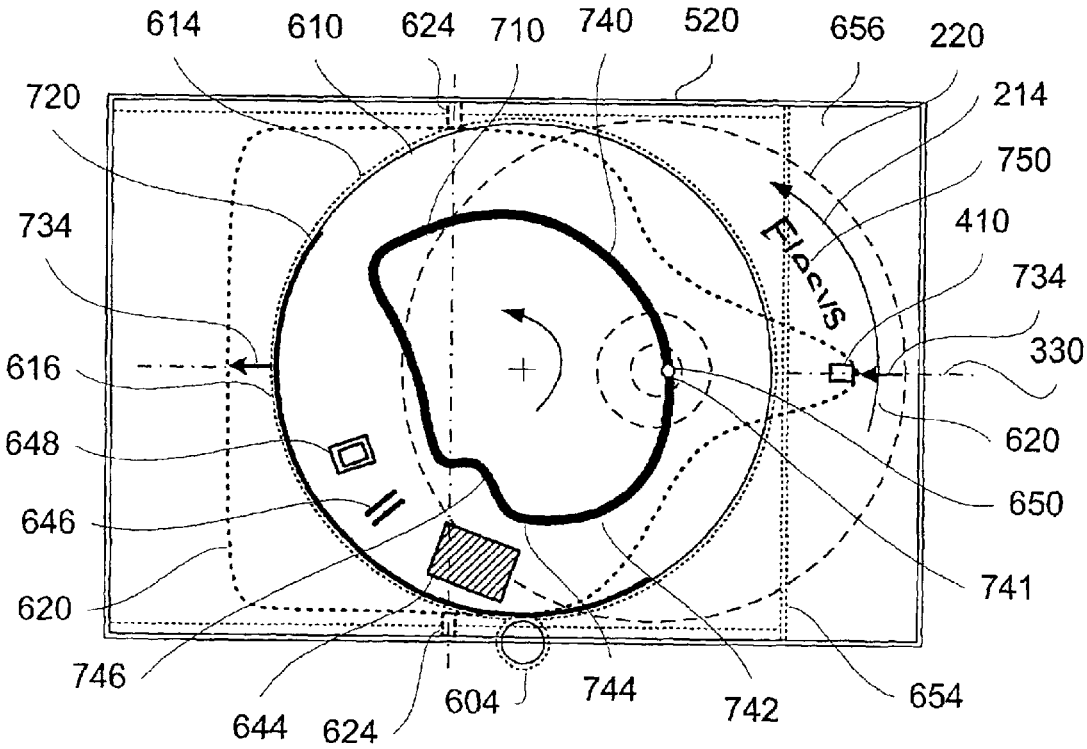
Figure 7C:
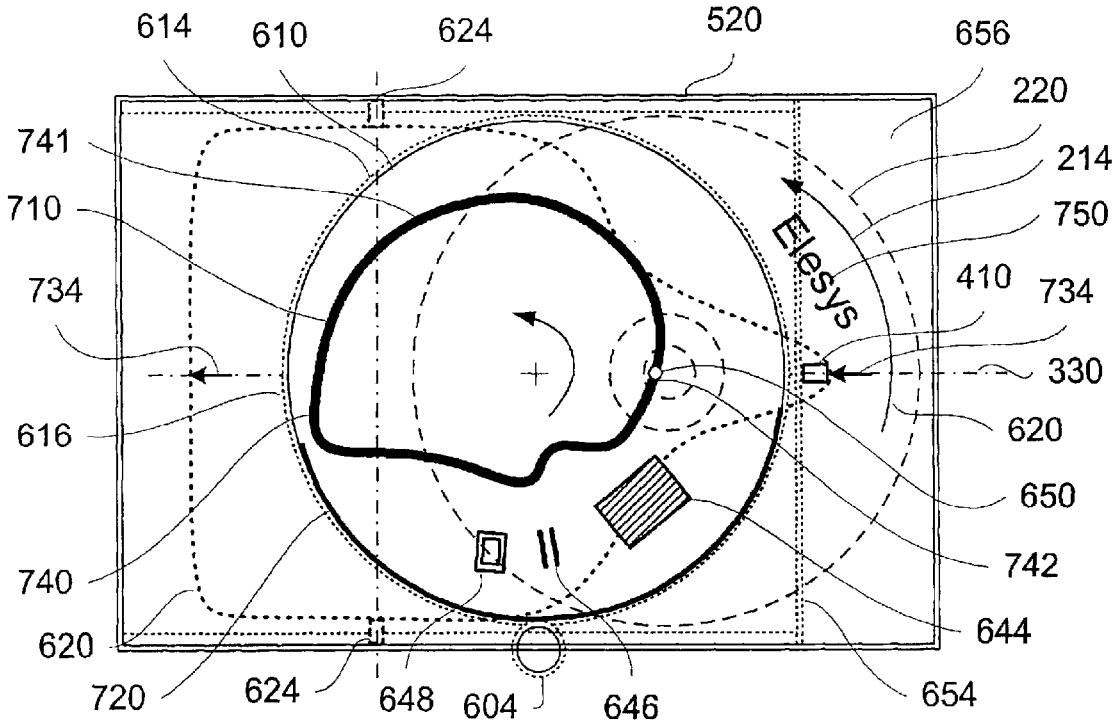
Figure 7D:
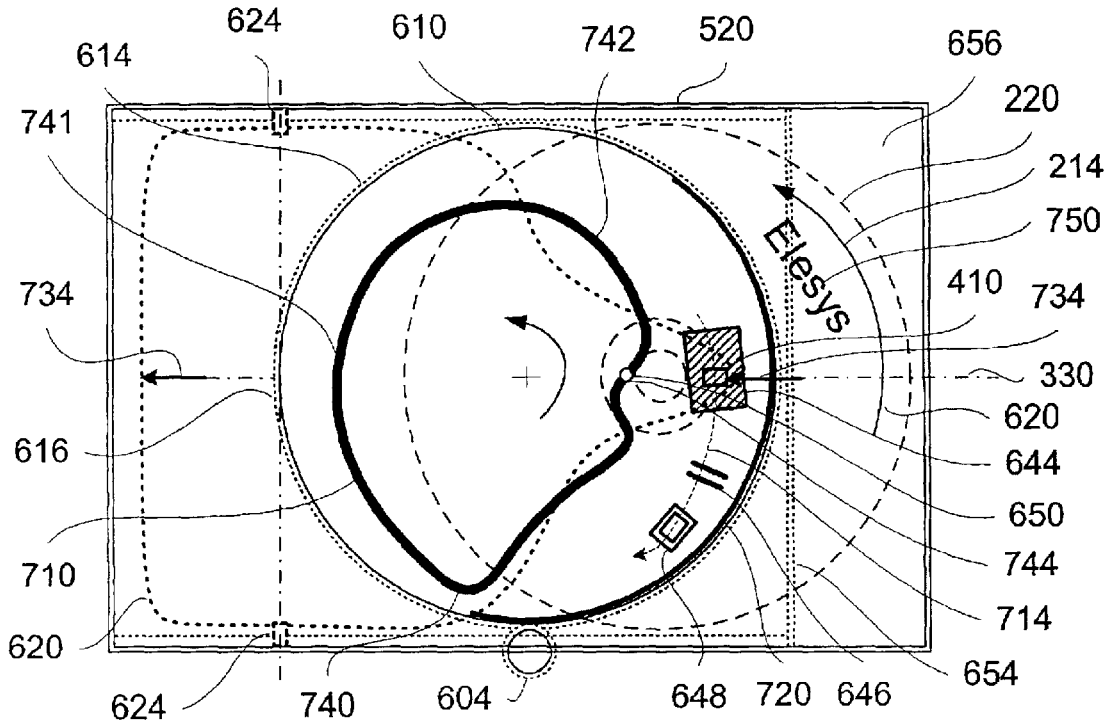
Figure 7E:
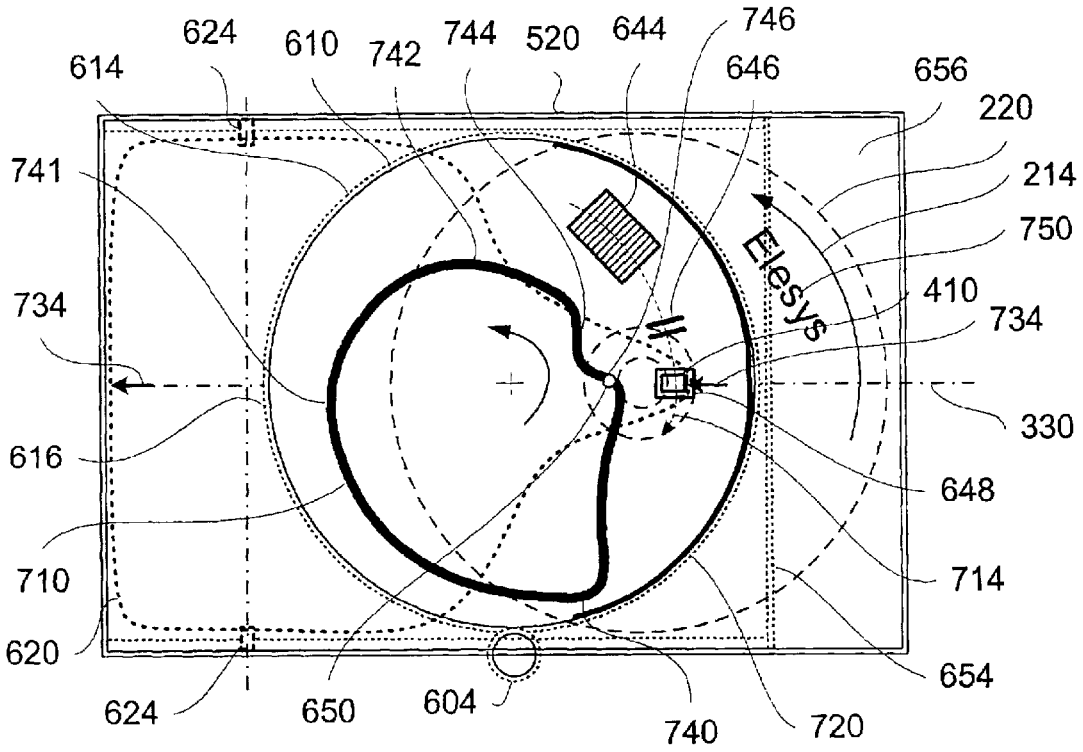
Figure 7F:
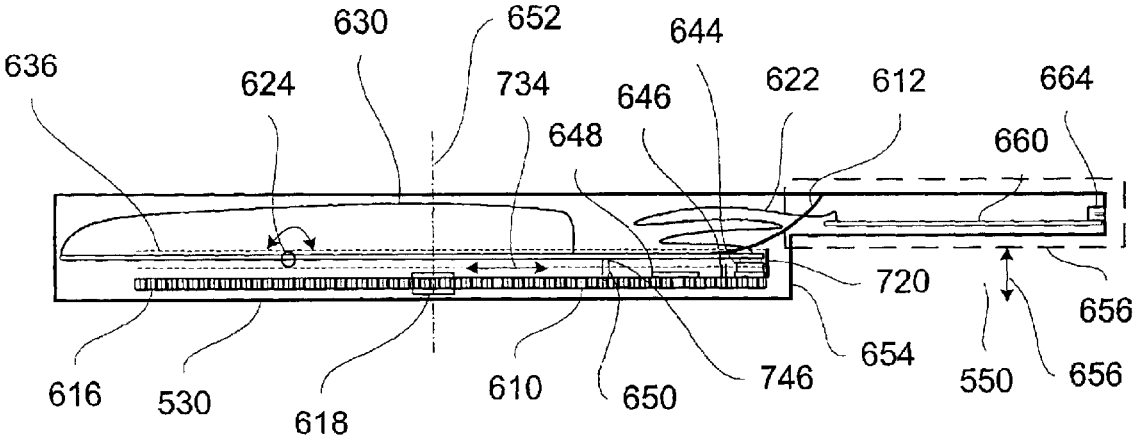
FIG. 7*f* is a diagrammatic side view representation of the cartridge and cam shutter wheel rotated with the print head fully retracted in the capped position and the cam shutter in the closed position in accordance with one embodiment of the present invention.

FIGS. 7*a*~7*e* are diagrammatic top view representations and FIG. 7*f* is a side view representation of the cam wheel 610 and print head 410 positioned in relation to the cartridge 520 and media 220 at various stages within the print and maintenance cycle in accordance with one embodiment of the present invention. When printing, the print head 410 end of the print head-bladder assembly 620 is forced out of the cartridge 520 via the guide pin 650 following track 710 by rotating the cam shutter wheel 610 to a maximum extension, position 740 on the cam, so as to be over the edge of the target media 220 (FIG. 7*a*). During the initial extension, the shutter 720 portion of the cam shutter wheel 610 opens as the cam wheel rotates and the print head 410 extends. In the present embodiment, during printing the print head 410 gradually moves radially along path 734 towards the radial center of the media 220 (FIG. 7*a*) along track 710 through consecutive positions towards the other edge of the media 220, starting at position 740, then on to position 741 approximately halfway through printing (FIG. 7*b*) towards the inner edge of the media 220 at position 742 (FIG. 7*c*) on the cam shutter wheel 610. However the direction of movement along the media 220 need not exclusively move from outer to inner portion of the media. For example, in an alternate embodiment (FIG. 9*a*), using a similar cam shutter wheel to guide the print head path, the print head 410 conversely moves in a path 914 from the inner edge to the outer edge of the media 220.

Figure 6D:
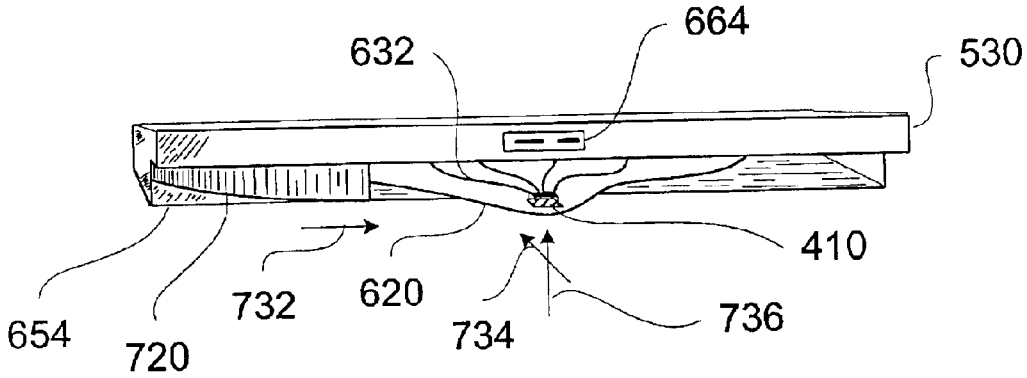
FIG. 6*d* is a diagrammatic perspective end view representation of the cam wheel of the cartridge FIGS. 6*a* and 6*b* in a partially closed position as the print head retracts in accordance with one embodiment of the present invention.

When finished printing, the print head 410 continues radially 734 into the service area of the wheel, following the relative path 720, as guided along by the cam wheel track, starting at position 744 to spit 716 (FIG. 7*d*), through the wipe blade 714 and function, and eventually into the cap 712 in cam wheel track position 746 (FIG. 7*e*). The print cycle may then either begin once more, or alternately prepare for cartridge ejection. During this final phase where the print head is reentering the cartridge for service in direction 734, the shutter 720 closes while rotating 732 over the cartridge opening, as shown in FIG. 6*d*, a diagrammatic end view of the cam wheel of the cartridge in a partially closed position in accordance with one embodiment of the present invention.

Figure 8A:
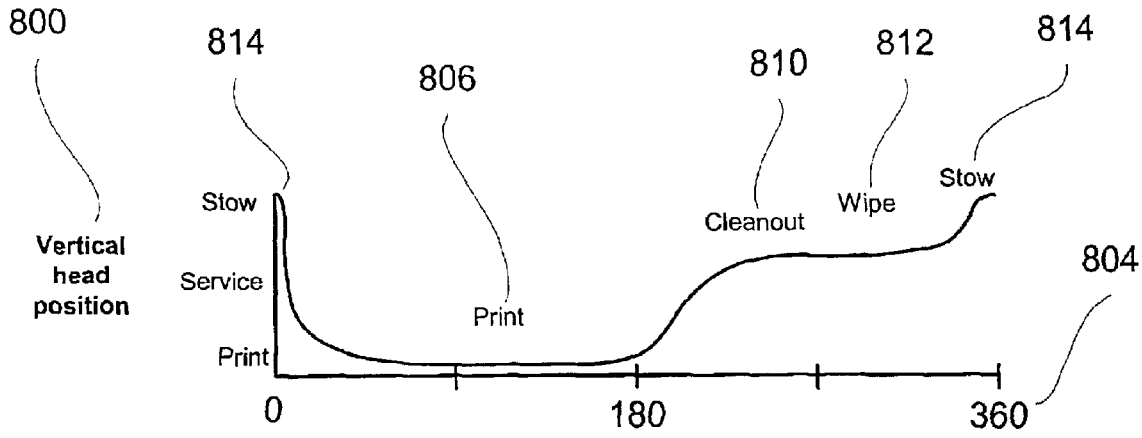
FIGS. 8*a* and 8*b* are illustrations of two charts representative of the relative vertical and horizontal positions, respectively, of the print head with respect to the CD-R media and cartridge housing in accordance with one embodiment of the present invention.
Figure 8B:
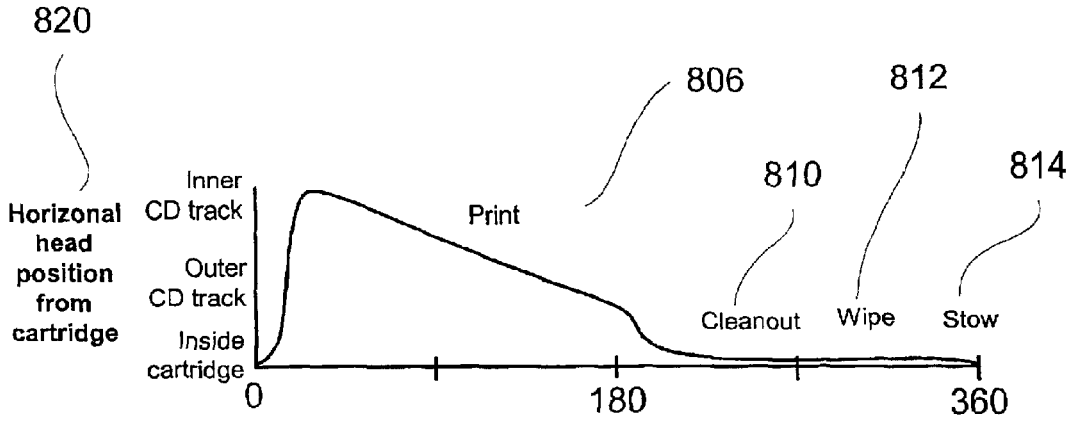

Referring to the print head relative vertical and horizontal positions in FIG. 8*b*, graph 820 illustrates the horizontal extension position of the print head 410 as a function of degrees rotation of the cam wheel 610, starting with 0 degrees in the stow position, illustrating the print head at various relative lateral positions as the guide pin 650 follows the lateral contours of the guide track 710 about the circuitous track 710 while the cam wheel 610 rotates. As shown, the print head 410 first extends all the way out to the starting edge of the CD-R, then gradually moves to the other edge of the CD-R, finally ending up in the service areas 644 and 646 and finally in the pen cap 648 stow position 814, in the process of cycling through graph regions 806, 810, 812 and 814, respectively, ready to repeat the cycle once more again. Similarly, FIG. 8*a* shows the vertical height of the print head profile, illustrating the print head at various relative heights as the guide pin 650 simultaneously follows the vertical contours of the guiding circuitous track 710 while the cam wheel 610 rotates. The stow-position 814 also prepares the cartridge 530 for ejection and removal. The stow-position 814 caps the print head 410 to prevent drying and damage from shock or inadvertent handling. When in this stow position, the cartridge cam shutter 720 (FIGS. 6*c* and 6*d*) is also in closed position, protecting the cartridge internals from damage and intrusive objects that may damage the mechanism and rupture the ink bladders.

Figure 9B:
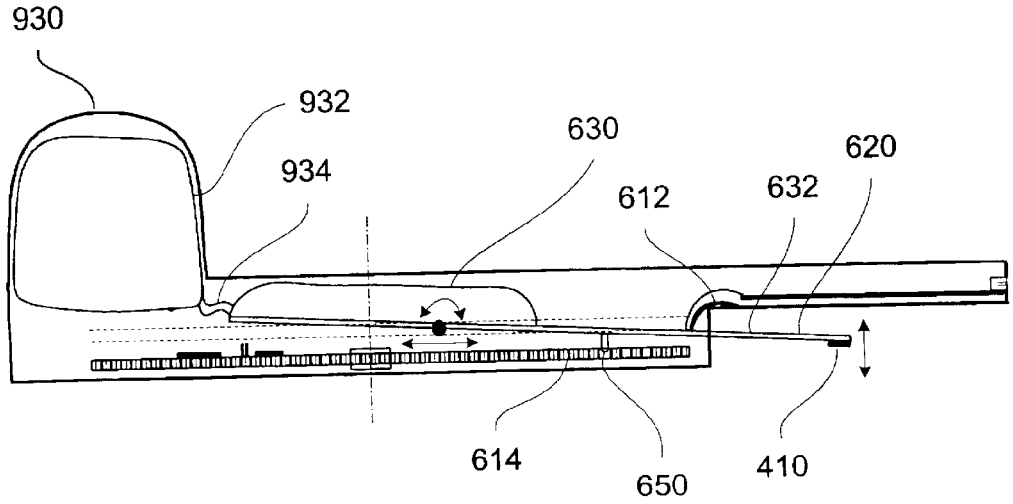

Similar to the aforementioned cartridge, FIGS. 9*a* and 9*b* are diagrammatic perspective view and side view representations, respectively, of an extended ink supply cartridge 930 for inserting into a CD-R printing system (510 and 520) in accordance with an alternative embodiment of the present invention. The cartridge 930 is similar to the cartridge of FIGS. 5~8*b*, except it includes a relatively large ink reservoir 932 which extends outside the printer assembly 520. The ink reservoir 932 may be coupled to the print head via flexible ink channels 934 or via a combination of ink channels 934 and additional ink reservoirs within the bladder assembly 630. The CD tray 514 of the CD-R device 510 may also be formed to extend out flush with the end of the reservoir housing 930 (not shown) to allow greater clearance. Additionally, the extended ink reservoir may be detachable from the rest of the cartridge 530 to allow easy replacement of the ink reservoir. For example, the ink reservoir may include nozzles 934 to attach to and remove from the cartridge at point 524.

Activation of the cartridge 530 may be accomplished through a series of commands to printer mechanism 520 from a hosting computer system or any combination of hardware and/or software. Printer assembly 520 attaches with and routes command signals and power through connector 664 (FIG. 6*b*) to the control circuitry 660 located in the panhandle 656 of the cartridge 530. The overall print operation is controlled by the printer mechanism 520 shown in FIG. 5, which receives, processes and ejects the print cartridge 530 from the host computer.

FIG. 10 is a diagrammatic representation of a radial printing and CD-R system 1000 in which the cartridge print system of the present invention may be implemented. As shown, the CD-R and radial print system 1000 includes the printer assembly 520 having a cartridge (not shown) as described above. The print head 410 extends out of the cartridge and moves along a radial path 414 by an actuator, while the media 100 spins 214 underneath the print head 410, which fires in along a trajectory 430 to place ink on the disc at a specific target location, also referred to as the print zone 440.

The Pen control system 1050 controls the positioning and firing of the pen 410. Images from the imaging algorithms 1072 are prepared by the imaging system 202 and synchronized with the synchronization system 204 with the rotational information from the encoder 1040 and in conjunction with the rotation motor 208 and servo 206. The pen 410 thereby synchronously prints radially to place ink objects at the target print zone 440. Mechanisms for enabling radial printing are further described in co-pending (1) U.S. patent application Ser. No. 10/125,681, filed 18 Apr. 2002, (2) U.S. patent application Ser. No. 09/815,064, filed 21 Mar. 2001, and (3) U.S. Pat. No. 6,264,295, issued 24 Jul. 2001, which applications and patent are incorporated herein by reference in their entirety.

Figure 11:
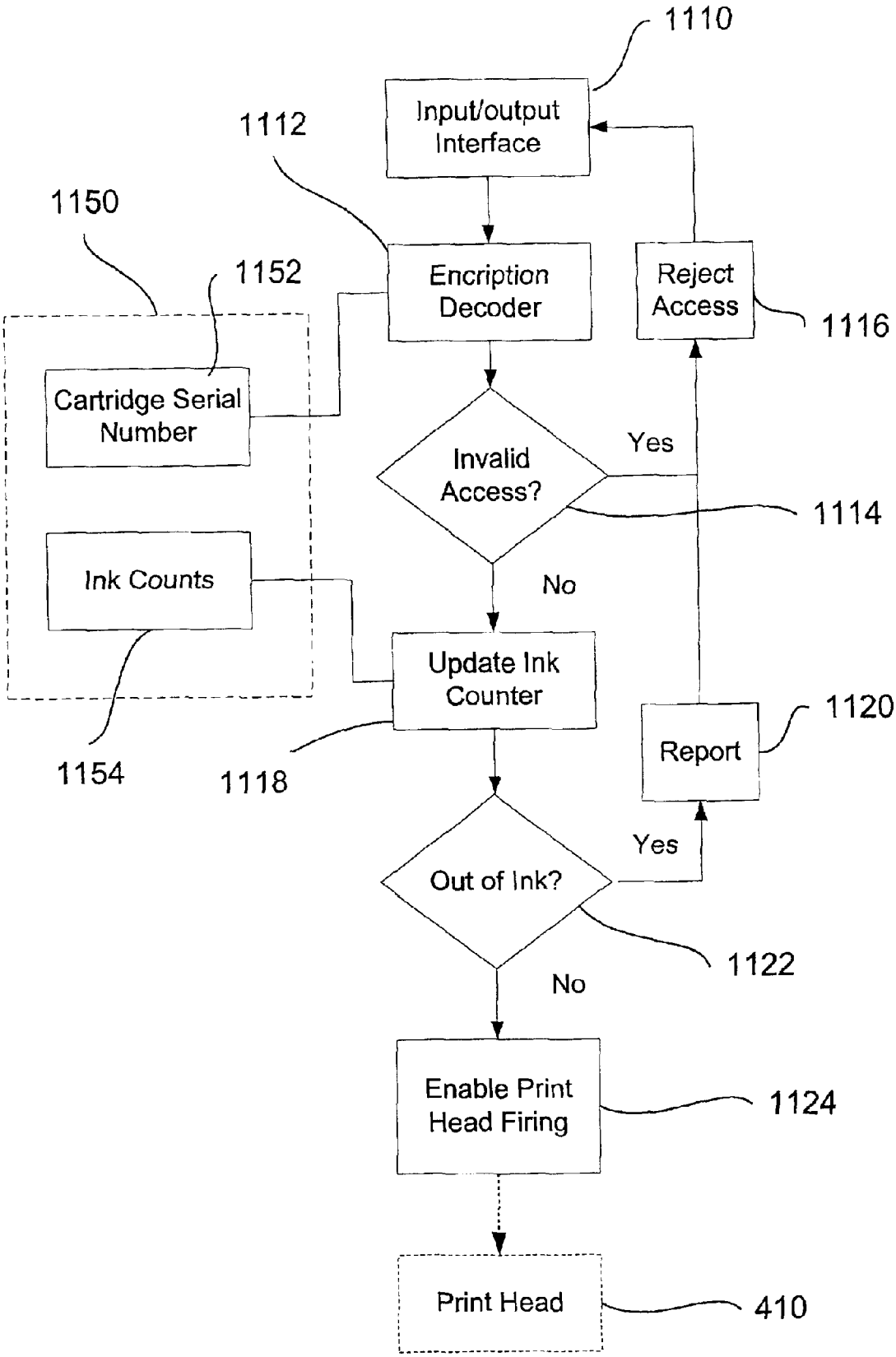
FIG. 11 is a block diagram of the on-board cartridge control circuitry of FIG. 6*b* in accordance with one embodiment of the present invention.

FIG. 11 is a block diagram of the on-board cartridge control circuitry 660 of FIG. 6*b* in accordance with one embodiment of the present invention. The components of the control circuitry 660 may be implemented within any suitable combination of hardware and/or software. As shown, the control circuitry includes an input/output interface 1110 for interfacing with the cartridge and may also include an encryption decoder 1112 for decoding an authentication code from the cartridge (e.g., via a cartridge serial number 1152). The control circuitry also may include a mechanism for determining whether the authentication code indicate invalid access by an invalid cartridge (1118). If the access is valid, an ink counter located within the printing assembly and/or cartridge 1150 may be updated or reset. Otherwise, access may be denied (1116) and the cartridge is unable to be used. This access mechanism may be implemented to ensure use of only a particular type of cartridge having an authentic serial number.

The control circuitry 660 may also include a mechanism for determining whether the cartridge 1150 has run out of ink (1122). If there is no more ink, a report (1120) may be generated to thereby deny access (1116) via the cartridge and discontinue printing. If there is enough ink, print head 410 firing may then be enabled (1124).

In another alternative printer assembly and cartridge embodiment (not shown), the print mechanism motor 606 and pinion gear 604 may also serve to pull in and eject the cartridge 530, when mating teeth are fashioned on the outer cartridge sidewall, and the pinion drive gear 604 mates with and moves the cartridge horizontally into position over the CD-R media.

In yet another alternative embodiment (not shown), an interlocking hook is used to mate to and engage with a recess in the outer cartridge sidewall, so that when the user partially inserts the cartridge, the cartridge thereafter automatically is moved horizontally into position over the CD-R media 220.

In another alternative embodiment, the cartridge 530 may couple to a lever arm through the front panhandle end 656 or front cartridge door 654 (FIGS. 6*b* and 6*d*), which positions the print head inward and outward along the radial centerline 330. In this embodiment, the print head bladder assembly 620, when activated by the level arm rather than pinion gear, would follow a modified track groove 636 on the inside of the cartridge 530 housing, profiling the vertical position 800 (FIGS. 8*a* and 8*b*) only of the print head position, while the print head service functions are still performed by the cam-shutter wheel. In yet another alternative embodiment (not shown), the print head service function may be performed instead by a sliding lever arm mechanism installed in place of the cam-shutter wheel.

Figure 12:
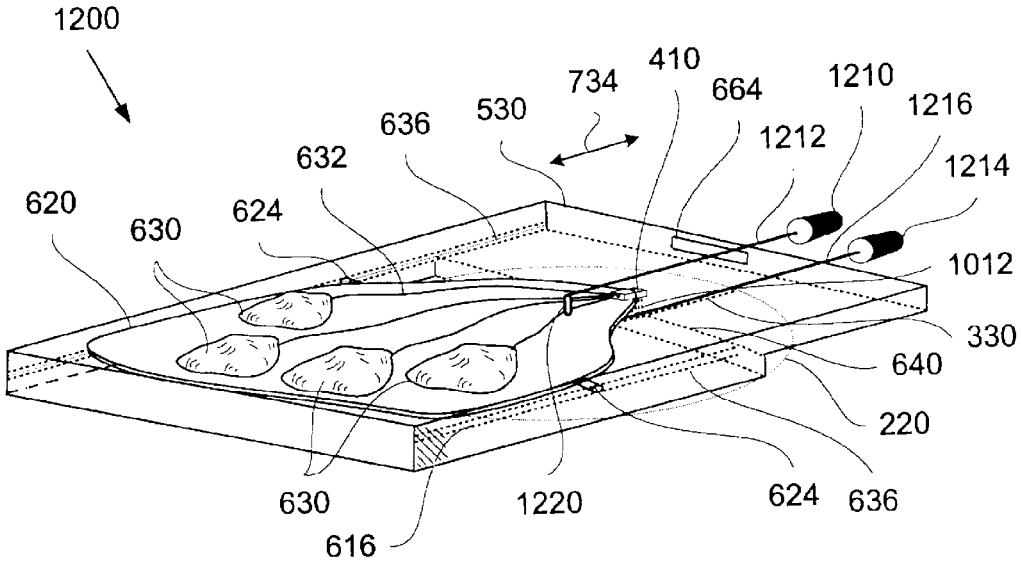
FIG. 12 is a diagrammatic perspective view representation a cartridge having motion mechanisms which use linear actuators in accordance with an alternative embodiment of the present invention.
Figure 13:
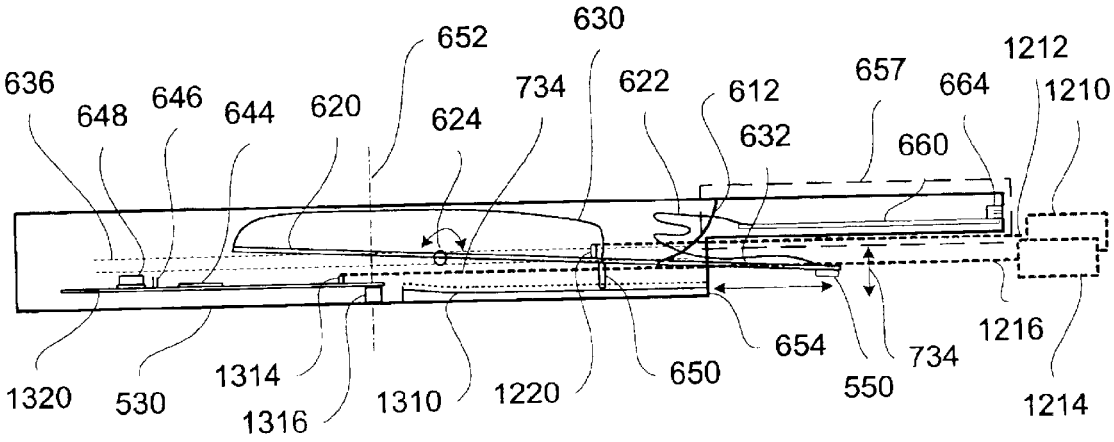
FIG. 13 is a diagrammatic representation of the side view of the linear actuators of FIG. 12, illustrating the relative vertical movement of internal components of the cartridge and the print head.
Figure 14:
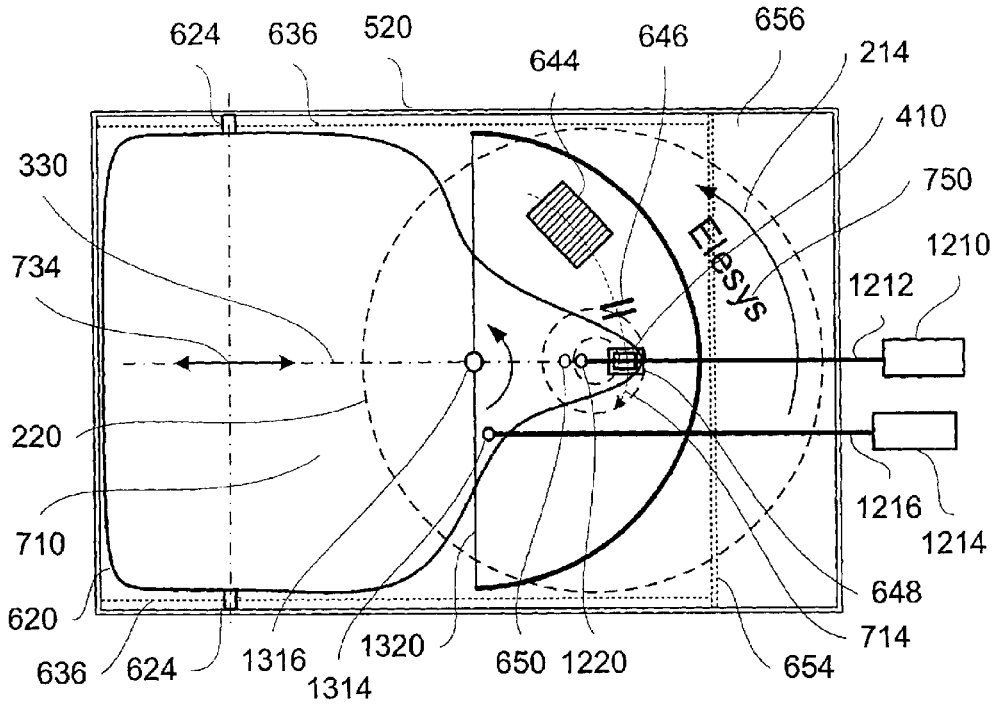
FIG. 14 is a diagrammatic representation of the top view of the linear actuators of FIG. 12.

FIG. 12 is a diagrammatic perspective view representation of a cartridge having motion mechanisms which use linear actuators in accordance with an alternative embodiment of the present invention. FIG. 13 is a diagrammatic representation of the side view of the linear actuators of FIG. 12, illustrating the relative vertical movement of internal components of the cartridge and the print head. FIG. 14 is a diagrammatic representation of the top view of the linear actuators of linear actuators of FIG. 12. As shown in FIGS. 12 and 13, the cartridge includes motion mechanisms in the form of two attachment mechanisms 1220 and 1314 for engaging with two external lever arms 1212 and 1216, respectively, which are in turn coupled with two motors 1210 and 1214, respectively. The lever arms and motors form part of the printer assembly (not shown). When the cartridge 530 is inserted within the printing assembly, the lever arms insert into the cartridge 530 to engage with the attachment mechanisms.

One attachment mechanism 1220 is coupled with the bladder assembly 620, and the other attachment mechanism 1314 is attached to a movable service platform 1320. When the lever arm 1212 is engaged with attachment mechanism 1220, the bladder assembly and print head 410 may be moved in direction 734 to thereby move the print head radially over the media 220. The bladder assembly 620 also rest within track 1310 via pin 650. Spring 612 provides pressure against the bladder assembly so the bladder assembly remains in track 1310.

Figure 15:
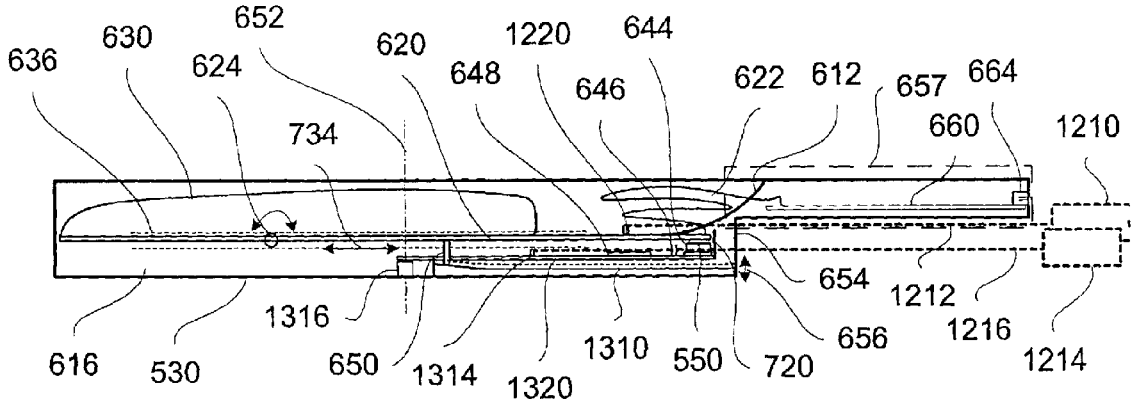
FIG. 15 is a diagrammatic representation of the side view of the linear actuators of FIG. 12, illustrating the relative vertical arrangement of significant internal components of the cartridge, with the print head shown in a capped position.

The track provides a vertical profile 656 for positioning of the print head 410. As the print head is moved out of the cartridge to a position over the media, the track 1310 serves to lower the print head. As the print head is retracted into the cartridge, the track 1310 serves to raise the print head. FIG. 15 is a diagrammatic representation of the side view of the linear actuators of FIG. 12, illustrating the relative vertical arrangement of significant internal components of the cartridge, with the print head shown in a capped position. The bladder assembly 620 include pivot points 624 which pivot and slide along side rail guide grooves 636 (FIG. 6*b*).

When the lever arm 1216 is engaged with attachment mechanism 1314, the movable service platform 1320 rotates clockwise 714 around pivot 1316 to thereby sequentially move a spit 644, wipe 646, and cap 648 under the print head 410 (see FIG. 14). The service station platform 1320 may have any suitable shape which allows maintenance of the print head, while not interfering with printing operations. As shown in FIG. 14, the service station platform 1320 may have a semi-circular shape.

In the preferred embodiment of this particular invention, the motion in the radial printer mechanism 520 is actuated by a "rack and pinion" gear. However, the motion could be actuated by a suitable actuator 1066 and motor 1060 (FIG. 10) in any suitable form for radially moving the print head 410 across the media 220. For example, the actuator 1066 and translational motor 1060 may be in the form of, among others, a screw drive and stepper motor, a voice coil, linear drive with feedback position, a band actuator and stepper motor, or a scissor joint attached to a gear or a linear actuator. A pinion gear 604 (FIG. 6*c*) driven by a motor 606 is mounted in the printer's housing 520 and the rack 616 is fashioned as gear teeth 616 on the outer circumference 614 of the cam shutter 610. As the cartridge 530 is inserted, the pinion 604 engages the rack 616 and the system synchronizes with print head position. During operations, the pinion gear 604 actuates the print head position profiles, illustrated in FIG. 8. The upper graph 800 (FIG. 8*a*) illustrates the vertical position throughout the 360-degree rotation of the cam shutter wheel 614. As shown therein, the print head 410 begins motion from a higher stow position 814 and moves to a lower print position 806, hovering over the CD-R media 220 surface while printing. When returning to the service areas 810 and 812, the print head 410 then moves back up, eventually ending in the stow position 814 ready to repeat the cycle one more.

In an alternative embodiment, the cam shutter wheel 610 may use a plurality of spirals instead of a single track 710 to move the print head 410 along the radius 330 of the CD-R media surface 220. In this alternative embodiment, the print head 410 is made to move more gradually, thereby increasing the effective radial resolution and precision to the radial motion with each additional rotation along the spiral track in the cam shutter wheel 610.

In sum, the cartridge 530 may be configured for activation of printing or forming a desired pattern of any type of media. The cartridge 530 may be configured for insertion and for internal or external actuation of the internal print head 410 and internal service station components 664, 646, and 648 (FIG. 6) in any form that is suitable for the implemented shape of the cartridge and radial printer assembly, whether as represented, for example, in 500 or 900 (FIG. 9) or any other suitable shape and configuration.

Although the foregoing invention has been described in some detail for purposes of clarity of understanding, it will be apparent that certain changes and modifications may be practiced within the scope of the appended claims. For example, the cam shutter is optional and may be excluded from the cartridge design. Additionally, the cartridge may easily be configured to move the print head initially from the outer edge of the media to the inner edge, rather that from the inner to outer edge. By way of another example, a multiple piece print head-ink bladder may be used. Therefore, the described embodiments should be taken as illustrative and not restrictive, and the invention should not be limited to the details given herein but should be defined by the following claims and their full scope of equivalents.

We claim:

1. A motorless printing cartridge for radially printing onto a rotating circular media, comprising:

an ink print head having a plurality of nozzles operable to dispense ink onto the rotating circular media; and a motion mechanism coupled with the ink print head to allow radial movement of the print head over the rotating circular media and to allow the print head to move relative to the motorless print cartridge.

2. A motorless printing cartridge as recited in claim 1, further comprising:

a print service component configured to service the print head by cleaning and/or capping the nozzles of the print head.

3. A printing cartridge for radially printing onto a rotating circular media, comprising:

an ink print head having a plurality of nozzles operable to dispense ink onto the rotating circular media; and a motion mechanism coupled with the ink print head to allow radial movement of the print head over the rotating circular media and to allow the print head to move relative to the print cartridge, wherein the motion mechanism is designed to be engaged with an actuator of a receptacle when the cartridge is coupled with the receptacle, the actuator being separate from the printing cartridge and operable to move the print head via the motion mechanism.

4. A printing cartridge as recited in claim 3, wherein the cartridge and the receptacle are arranged together so that the cartridge remains in a fixed position with respect to the rotating media when the print head is moving over the media.

5. A printing cartridge as recited in claim 3, wherein the motion mechanism includes an attachment mechanism coupled with the print head, and wherein the attachment mechanism is engaged with the actuator of the receptacle when the cartridge is coupled with the receptacle, the actuator being operable to move the print head via the attachment mechanism.

6. A printing cartridge as recited in claim 5, wherein the actuator includes a motor coupled with a lever arm which is engaged with the attachment mechanism when the cartridge is inserted within the receptacle.

7. A printing cartridge as recited in claim 3, wherein the cartridge is sized to couple with a printer receptacle.

8. A printing cartridge as recited in claim 7, wherein the printer receptacle is positioned adjacent to or integrated with a standard slimline CD-R device, so that a combination of the cartridge, the printer receptacle and the standard slimline CD-R device substantially fit within a standard ½ height computer bay.

9. A printing cartridge for radially printing onto a rotating circular media, comprising:

an ink print head having a plurality of nozzles operable to dispense ink onto the rotating circular media; and a motion mechanism coupled with the ink print head to allow radial movement of the print head over the rotating circular media, wherein the motion mechanism is designed to be engaged with an actuator of a receptacle when the cartridge is coupled with the receptacle, the actuator being operable to move the print head via the motion mechanism, and wherein the motion mechanism is a cam wheel having a groove for receiving a pin coupled to the print head, and wherein the cam wheel is engaged with the actuator of the receptacle when the cartridge is coupled with the receptacle, the actuator being operable to rotate the cam wheel and move the print head via the pin moving along the groove.

10. A printing cartridge as recited in claim 9, wherein the motion mechanism further comprises a bladder assembly for supporting an ink reservoir coupled to the print head, wherein the bladder assembly is also coupled with the print head.

11. A printing cartridge as recited in claim 10, wherein the bladder assembly includes two pivots on two opposing sides of the bladder assembly, the pivots being positioned to slidably and pivotably engage with two rails of an inside surface of the cartridge.

12. A printing cartridge as recited in claim 9, wherein the groove is configured to allow vertical and horizontal movement of the print head when the cam wheel rotates.

13. A printing cartridge as recited in claim 12, wherein the cam wheel includes a service station for maintaining the print head.

14. A printing cartridge as recited in claim 13, wherein the service station includes a spit, a wipe, and a cap device.

15. A printing cartridge as recited in claim 14, wherein the groove is further configured to rotate the print head over the service station.

16. A printing cartridge for radially printing onto a rotating circular media, comprising:

an ink print head having a plurality of nozzles operable to dispense ink onto the rotating circular media; and a motion mechanism coupled with the ink print head to allow radial movement of the print head over the rotating circular media, wherein the motion mechanism includes an attachment mechanism coupled with the print head, and wherein the attachment mechanism is engaged with the actuator of the receptacle when the cartridge is coupled with the receptacle, the actuator being operable to move the print head via the attachment mechanism, wherein the actuator includes a motor coupled with a lever arm which is engaged with the attachment mechanism when the cartridge is inserted within the receptacle, and wherein the motion mechanism includes a second attachment mechanism coupled with a service platform, and wherein the second attachment mechanism is engaged with a second actuator of the receptacle when the cartridge is coupled with the receptacle, the second actuator being operable to move the service platform with respect to the print head via the second attachment mechanism.

17. A method of radially printing onto a rotating media using a motorless printing cartridge having an ink print head having a plurality of nozzles operable to dispense ink onto the rotating circular media and a motion mechanism coupled with the ink print head to allow radial movement of the print head over the rotating circular media, the method comprising:

engaging with the motion mechanism of the motorless printing cartridge to thereby move the print head over the rotating circular media and to thereby move the print head relative to the motorless printing cartridge; and dispensing ink onto the rotating circular media.

18. A method as recited in claim 17, further comprising engaging with the motion mechanism of the motorless printing cartridge to thereby activate servicing of the print head.

19. A method as recited in claim 18, further comprising inserting the cartridge into a combination compact disc recorder and printer system to activate engagement of the motion mechanism of the cartridge.

20. A method as recited in claim 19, wherein the combination is sized to fit within a standard height computer bay.

21. A method of radially printing onto a rotating media using a printing cartridge having an ink print head having a plurality of nozzles operable to dispense ink onto the rotating circular media and a motion mechanism coupled with the ink print head to allow radial movement of the print head over the rotating circular media, the method comprising:

inserting the cartridge into a slimline printer system to activate engagement of the motion mechanism of the cartridge;

engaging with the motion mechanism of the cartridge to thereby activate servicing of the print head;

engaging with the motion mechanism of the cartridge to thereby move the print head over the rotating circular media and to thereby move the print head relative to the cartridge; and dispensing ink onto the rotating circular media.

22. A radial printing and compact disc recording (CD-R) system, comprising:

a CD-R drive for recording on a rotating media, the CD-R drive having a standard slimline size; and a radial printing receptacle arranged to receive a printing cartridge, wherein the cartridge includes:

an ink print head having a plurality of nozzles operable to dispense ink onto the rotating media; and a motion mechanism coupled with the ink print head to allow radial movement of the print head over the rotating media and to allow the print head to move relative to the printing cartridge; and wherein the radial printing receptacle being positioned adjacent to or integrated with the CD-R drive, the radial printing receptacle and printing cartridge being operable to print onto the rotating media.

23. A system as recited in claim 22, wherein the motion mechanism is designed to be engagable with an actuator of a receptacle when the printing cartridge is coupled with the receptacle, the actuator being separate from the printing cartridge and operable to move the print head via the motion mechanism.

24. A printing cartridge as recited in claim 22, wherein the motion mechanism is coupled with the ink print head to allow the ink print head to extend outside of the printing cartridge.

25. A system as recited in claim 22, wherein the radial printing receptacle and cartridge are sized such that a combination of the radial printing receptacle, printing cartridge, and CD-R drive substantially fit within a standard ½ height computer bay.

26. A printing cartridge for radially printing onto a rotating circular media, comprising:

an ink print head having a plurality of nozzles operable to dispense ink onto the rotating circular medial; and a motion mechanism coupled with the ink print head to allow radial movement of the print head over the rotating circular media and to allow the print head to move relative to the printing cartridge, wherein the motion mechanism is coupled with the ink print head to allow the ink print head to extend outside of the printing cartridge.

27. A method of radially printing onto a rotating media using a printing cartridge having an ink print head having a plurality of nozzles operable to dispense ink onto the rotating circular media and a motion mechanism coupled with the ink print head to allow radial movement of the print head over the rotating circular media, the method comprising:

engaging with the motion mechanism of the cartridge to thereby move the print head over the rotating circular media and to thereby move the print head relative to the cartridge, wherein engaging the motion mechanism comprises coupling with the ink print head to allow the ink print head to extend outside of the printing cartridge; and dispensing ink onto the rotating circular media.

* * * * *